US006070968A

United States Patent [19]

Akino et al.

[11] Patent Number: 6,070,968

[45] **Date of Patent: *Jun. 6, 2000**

[54] INK JET CARTRIDGE AND APPARATUS HAVING A SUBSTRATE WITH GROOVES WHICH CONTAIN HEAT GENERATING ELEMENTS

[75] Inventors: Yutaka Akino, Isehara; Kenji Makino, Yokohama; Akira Okita, Ayase; Seiichi Tamura, Atsugi, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/361,048

[22] Filed: Dec. 21, 1994

[30] Foreign Application Priority Data

Dec. 22, 1993 [JP] Japan ..... 5-325153

[51] Int. Cl.[7] ..... B41J 2/05

[52] U.S. Cl. ..... 347/59; 347/50; 347/85

[58] Field of Search ..... 347/50, 63, 65, 347/85, 87, 58, 59, 67

[56] References Cited

U.S. PATENT DOCUMENTS

| | | | |
|---|---|---|---|
| Re. 32,572 | 1/1988 | Hawkins et al. | 347/63 |
| 4,376,945 | 3/1983 | Hara et al. | 347/67 |
| 5,376,231 | 12/1994 | Matsumoto et al. | 347/59 |

FOREIGN PATENT DOCUMENTS

| | | | |
|---|---|---|---|
| 57-72867 | 5/1982 | Japan . | |
| 5220960 | 8/1993 | Japan | 347/63 |

*Primary Examiner*—N. Le
*Assistant Examiner*—Shih-wen Hsieh
*Attorney, Agent, or Firm*—Fitzpatrick, Cella, Harper & Scinto

[57] ABSTRACT

An object of the present invention is to provide an ink jet recording head and an apparatus using the same, wherein electrothermal conversion element for thermally emitting a recording ink is provided at a side of a substrate on which the head structure is formed, thereby reducing a loss in the thermal energy.

13 Claims, 21 Drawing Sheets

INK JET CARTRIDGE AND APPARATUS HAVING A SUBSTRATE WITH GROOVES WHICH CONTAIN HEAT GENERATING ELEMENTS

BACKGROUND OF THE INVENTION

1. Field of the Invention

The present invention relates to a recording head element substrate having electricity-heat converters and recording function elements formed on the substrate, an ink jet head using the recording head element substrate, an ink jet head cartridge thereof, and an ink jet apparatus which adopts the ink jet head, and is useful for an output printer or video output printer for a copying machine, a facsimile, a word processor, and a host computer.

2. Related Background Art

Conventionally, the constitution of recording heads has been made such that an array of electricity-heat conversion elements is formed on a single crystal silicon substrate, function elements for driving the electricity-heat conversion elements such as a transistor array are arranged outside the silicon substrate as a drive circuit for the electricity-heat conversion elements, and the connection between the electricity-heat conversion elements and the transistor array is made by wire bonding.

For the purposes of providing a simplified structure to be considered for the above head constitution, reducing the failure which may arise in the manufacturing process, or providing the uniform characteristic or improved reproducibility for each element, an ink jet recording apparatus is known which has a recording head having electricity-heat conversion elements and function elements provided on the same substrate, as proposed in Japanese Laid-open Patent Application No. 57-72867.

FIG. 16 is a typical cross-sectional view showing a part of a recording head substrate as constituted above. 901 is a semiconductor substrate composed of single crystal silicon. 902 is an epitaxial region of N-type semiconductor, 903 is an ohmic contact region of N-type semiconductor having a high impurity density, 904 is a base region of P-type semiconductor, and 905 is an emitter region of N-type semiconductor having a high impurity density, whereby a bipolar transistor 920 is formed of them. 906 is an oxide silicon layer serving as a heat storing layer and an insulating interlayer, 907 is a heating resistive layer, 908 is a wiring electrode made of aluminum (Al), 909 is an oxide silicon layer as a protective layer, whereby a recording head base body 930 is formed of them. Here, 940 serves as a heating portion. A recording head is constructed by a ceiling plate and the liquid channels formed on this base body 930.

By the way, the structure as described above may be superior, but there is yet much room for improvement to meet the high speed driving, the energy saving, the high integration, the lower costs, and the high reliability which have been strongly demanded for the recording apparatus in recent years.

First, the recording head having high reliability must be provided at low price. To this end, with the conventional recording head, the heating portion of heater and a driving portion and the ink nozzle portion are separately formed, after which they are bonded together in alignment. However, with this method, the heating center of heater may be offset from the center of nozzle, more likely resulting in the degraded performance of the recording head. To effect the fast driving stably, it is important to stabilize the bubbling performance of the ink. Also, it is necessary for the fast driving to make the bubbling center of ink nozzle closer to the nozzle head. For this purpose, the use of higher resistive heater and the effective use of calorific value are required.

The heater provided on the silicon substrate has its calorific value partly leaking away to the silicon substrate, and is required to generate more heat for the bubbling. To prevent such leaking of the heat to the silicon substrate, a lower heat conductive material must be formed thick under the heater. Normally, a silicon oxide film is used under the heater, in which it takes much time to form the thick silicon oxide film.

Also, in the ink jet head using heating elements, it is increasingly demanded, with the higher function of the driving elements, that the heat generated by the heating elements is prevented from passing to the driving elements.

SUMMARY OF THE INVENTION

To accomplish such objects, there is provided an ink jet head in the main constitution comprising a plurality of electricity-heat conversion elements for generating the heat energy to be applied to the ink and function elements each electrically connected to each electricity-heat conversion element for driving said electricity-heat converters, which are formed on the same element substrate, wherein said element substrate has a plurality of grooves constituting the ink flow passages for supplying the ink to the discharge orifices, said electricity-heat conversion elements being provided on the side walls of said grooves.

Or there is provided an ink jet head comprising a first element substrate having a plurality of grooves which constitute ink flow passages for supplying the ink to said discharge orifices, and electricity-heat conversion elements, disposed within said grooves, for generating the heat energy to be applied to the ink, and a second element substrate having function elements for driving said electricity-heat converters incorporated therein, wherein the ink flow passages are formed between said grooves of said first element substrate and said second element substrate by bonding said first and second element substrates together, and the electricity-heat converters of said first element substrate and the function elements of said second element substrate are electrically connected.

Also, to accomplish the above objects, there is provided an ink jet head cartridge in the main constitution comprising any one of the ink jet heads as above described, and an ink container for holding the ink to be supplied to the ink jet head.

Also, to accomplish the above objects, there is provided an ink jet apparatus in the main constitution comprising any one of the ink jet heads as above described, and recording medium conveying means for conveying the recording medium which receives the ink discharged from said ink jet head, or an ink jet apparatus comprising any one of the ink jet recording heads as above described, and driving signal supply means for supplying a signal for driving the ink jet recording head to this ink jet head.

As above described, the element substrate comprises the grooves provided with the heating elements, the registration between the heater center and the ink nozzle can be effected in self-alignment by incorporating the nozzles into the silicon substrate, whereby it is possible to fabricate a nozzle head simply by placing a flat ceiling plate thereon after the diode manufacturing process and without bonding separately fabricated products together in alignment. Where the heater is formed substantially vertically but not horizontally with respect to the silicon substrate, it is further possible to make the apparatus smaller and faster by reducing the amount of heat radiating to the silicon substrate.

Also, the heaters (heating elements) may be formed within the ink grooves, and bonded with the element substrate having the function elements for the drive incorporated therein to attain the same effect. In such a case, the conduction of the heat from the heating elements to the function elements can be suppressed.

DETAILED DESCRIPTION OF THE PREFERRED EMBODIMENTS

Figure 1:
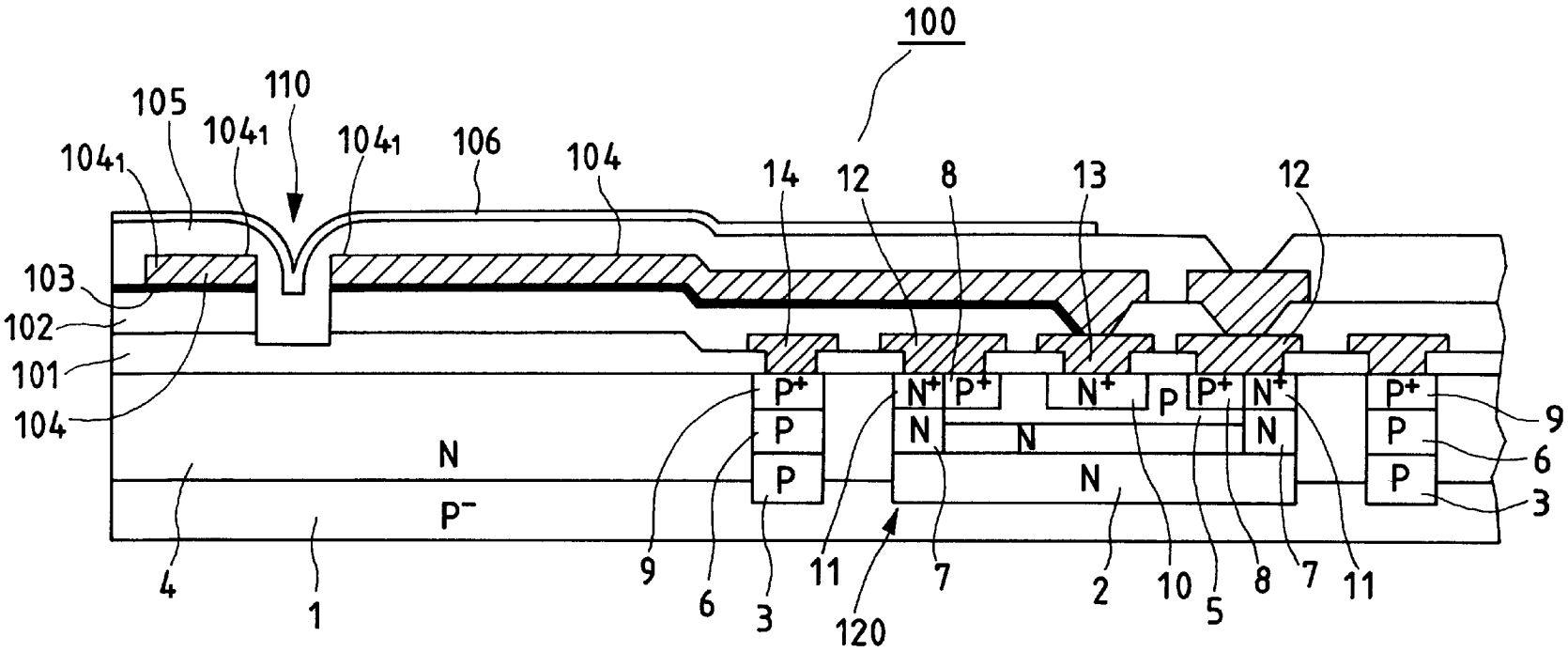
FIG. 1 is a typical cross-sectional view of an element substrate for an ink jet head according to the present invention.

FIG. 1 is a typical cross-sectional view of a recording head base body according to the present invention.

A recording head element substrate 100 has a heating portion 110 which is an electricity-heat conversion element and an NPN transistor 120 of the bipolar type which is a driving function element formed on a P-type silicon substrate 1.

In FIG. 1, 1 is a P-type silicon substrate, 2 is an N-type collector buried region for constituting the function element, 3 is a P-type isolation buried region for the separation of function elements, 4 is an N-type epitaxial region, 5 is a P-type base region for constituting the function element, 6 is a P-type isolation region for the separation of elements, 7 is an N-type collector region for constituting the function element, 8 is a high density P-type base region for constituting the element, 9 is a high density P-type isolation region for the separation of elements, 10 is a high density N-type emitter region for constituting the element, 11 is a high density N-type collector region for constituting the element, 12 is a collector/base common electrode, 13 is an emitter electrode, and 14 is an isolation electrode. Herein, an NPN transistor 120 is formed, so that the collector regions 2, 7, 11 can completely surround the emitter region 10 and the base region 5, 8. Also, each cell is surrounded by the P-type isolation buried region 3, the P-type isolation region 6 and the high density P-type isolation region 9 as an element separation region, and electrically isolated.

Herein, the NPN transistor 120 has a structure of NPN transistor comprising two high density N-type collector regions 11 formed via the N-type collector buried region 2 and the N-type collector buried region 2 on the P-type silicon substrate 1, two high density P-type base regions 8 formed via the N-type collector buried region 2 and the P-type base region 5 inside the high density N-type collector region 11, and the high density N-type emitter region 10 formed via the N-type collector buried region 2 and the P-type base region 5 and sandwiched between the high density P-type base regions 8, but can operate as a diode by connecting the high density N-type collector regions 11 and the high density P-type base regions 8 at the collector/base common electrode 12. Also, the P-type isolation buried region 3, the P-type isolation region 6 and the high density P-type isolation region 9 are formed in sequence adjacent to the NPN transistor 120. Also, the heating resistive layer 103 is formed via the N-type epitaxial region 4, a heat storage layer 101 and an interlayer film 102 on the P-type silicon substrate 1, and the heating portion 110 is constituted by cutting out a wiring electrode 104 formed on a heating resistive layer 103 to form two edges $\mathbf{104}_1$ which are end faces for connection, respectively.

The recording head element substrate 100 is covered with the heat storage layer 101 formed of a thermal oxide film over the entire surface, electrodes 12, 13, 14 formed of Al being provided on the function elements.

The element substrate 100 in this example is covered with the heat storage layer 101 having the collector/base common electrode 12, the emitter electrode 13, and the isolation electrode 14 formed on the P-type silicon substrate 1 for the recording head having a driving portion (function elements) as above described, and on its upper layer is formed the interlayer film 102 made of a thermal silicon film by PCVD or sputtering. Al forming each of electrodes 12, 13, 14 has an inclined side face, and the interlayer film 102 is so excellent in the step coverage property that it can be formed thinner than the conventional one as far as the heat storage effect is not lost. The emitter electrode 13 and the isolation electrode 14 are electrically connected at the collector/base common electrode 12 by opening the interlayer film 102 partially, and the wiring electrode 104 made of Al for forming the electrical wirings is placed on the interlayer film 102. That is, after opening the interlayer film 102 partially, electricity-heat conversion elements composed of the heating resistive layer 103 made of $HfB_2$ by sputtering and the wiring electrode 104 made of Al by vapor deposition or sputtering are provided. Examples of the material for constituting the heating resistive layer 103 may include Ta, $ZrB_2$, Ti—W, Ni—Cr, Ta—Al, Ta—Si, Ta—Mo, Ta—W, Ta—Cu, Ta—Ni, Ta—Ni—Al, Ta—Mo—Al, Ta—Mo—Ni, Ta—W—Ni, Ta—Si—Al, and Ta—W—Al—Ni.

The fundamental operation of the function elements (driving portion) with the above constitution will be now explained.

Figure 2:
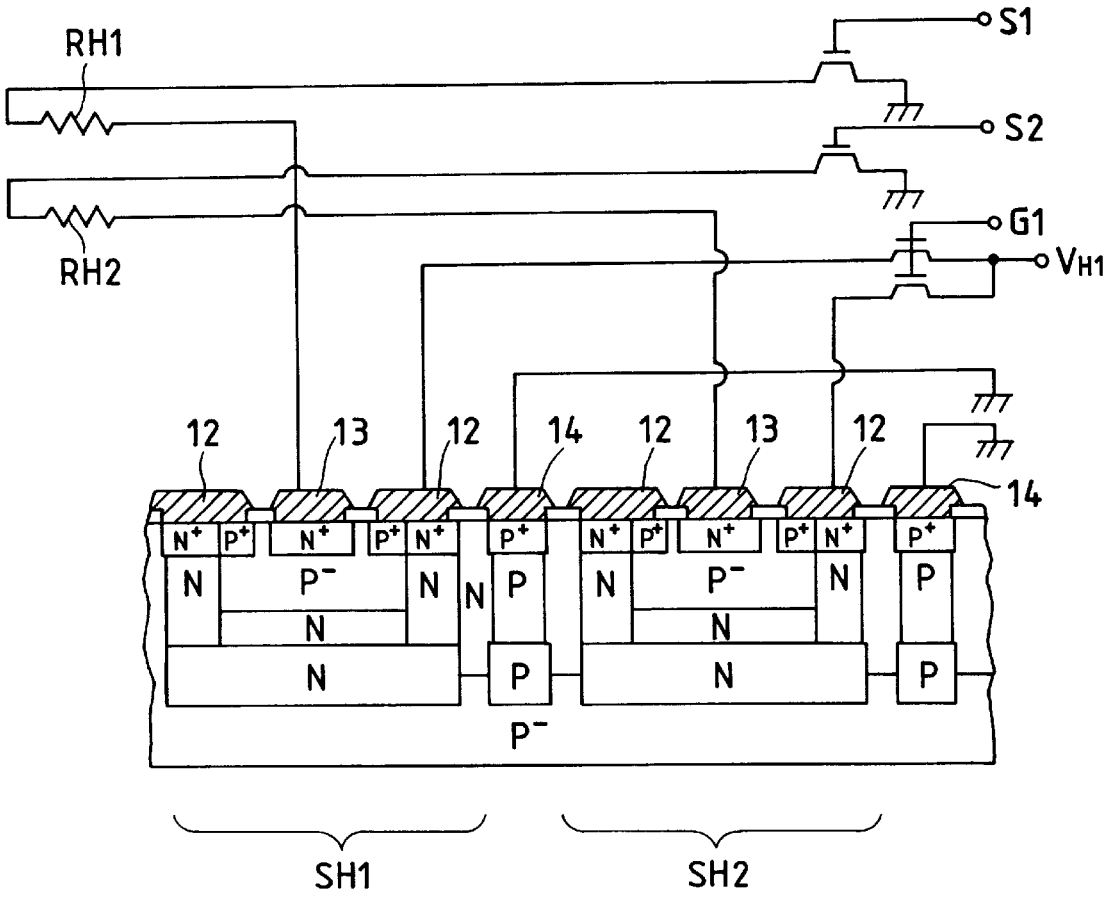
FIG. 2 is a typical view for explaining a driving method for the element substrate as shown in FIG. 1.

FIG. 2 is a typical view for explaining a driving method of the element substrate 100 as shown in FIG. 1.

In this example, the collector/base common electrode 12 corresponds to an anode electrode of diode, and the emitter electrode 13 corresponds to a cathode electrode, as shown in FIGS. 1 and 2. That is, by applying a bias ($V_{H1}$) of positive potential to the collector/base common electrode 12, the NPN transistor within each cell (SH1, SH2) is turned on, so that a bias current flows out of the emitter electrode 13 as a collector current and a base current. Also, as a result of having the base and the collector short-circuited, the heat rising and falling characteristics of the electricity-heat conversion elements (RH1, RH2) became excellent, thereby enhancing the controllability for the excitation of the film boiling phenomenon, and the growth and shrinkage of bubbles produced thereby, so that the ink was stably discharged. This is considered because it has a great effect more than expected that the ink jet recording head using the heat energy involves deep relationship between the transistor characteristics and the film boiling characteristics, and has less storage of minority carriers in the transistor, so that the switching characteristic is fast and the rising chracteristic is enhanced. Also, because of relatively less parasitic effect and no variation between elements, the stable driving current can be obtained.

In this example, the flow of the current into adjacent other cells can be prevented by further grounding the isolation electrode 14, so that the malfunction of other elements can be prevented.

In such a semiconductor device, it is desirable to have the density of the N-type collector buried region to be $1\times10^{18}$ $cm^{-3}$ or greater, the density of the P-type base region 5 to be from $5\times10^{14}$ to $5\times10^{17}$ $cm^{-3}$, and make the area of a junction face between the high density base region 8 and the electrode as small as possible. By doing so, it is possible to prevent the occurrence of any leakage current passing from the NPN transistor through the P-type silicon substrate 1 and the isolation region to the ground.

The above element substrate driving method will be further detailed.

In FIG. 2, only two semiconductor function elements (cells) are shown, but in practice, such function elements are arranged at an equal interval corresponding to and in the same number as 128 electricity-heat conversion elements, and connected in matrix electrically to enable the block driving. Herein, for the simpler explanation, the driving of electricity-heat conversion elements RH1, RH2, as two segments in the same group will be explained below.

In order to drive an electricity-heat conversion element RH1, a group is first selected by a switching signal G1, and the electricity-heat conversion element RH1 is selected by the switching signal G1. Then, a diode cell SH1 of the transistor constitution is forward-biased to supply the current, so that the electricity-heat conversion element RH1 is heated. The liquid is discharged through discharge orifices as the heat energy causes state changes in the liquid to produce bubbles.

Similarly, in driving an electricity-heat conversion element RH2, the electricity-heat conversion element RH2 is selected by the switching signal G1 and a switching signal S2 to drive a diode cell SH2 to supply the current to the electricity-heat converter.

Herein, the P-type silicon substrate 1 is grounded via the isolation regions 3, 6, 9. In this way, by placing the isolation regions 3, 6, 9 of each semiconductor element (cell), the malfunction due to electrical interference between each semiconductor element is prevented.

Figure 3:
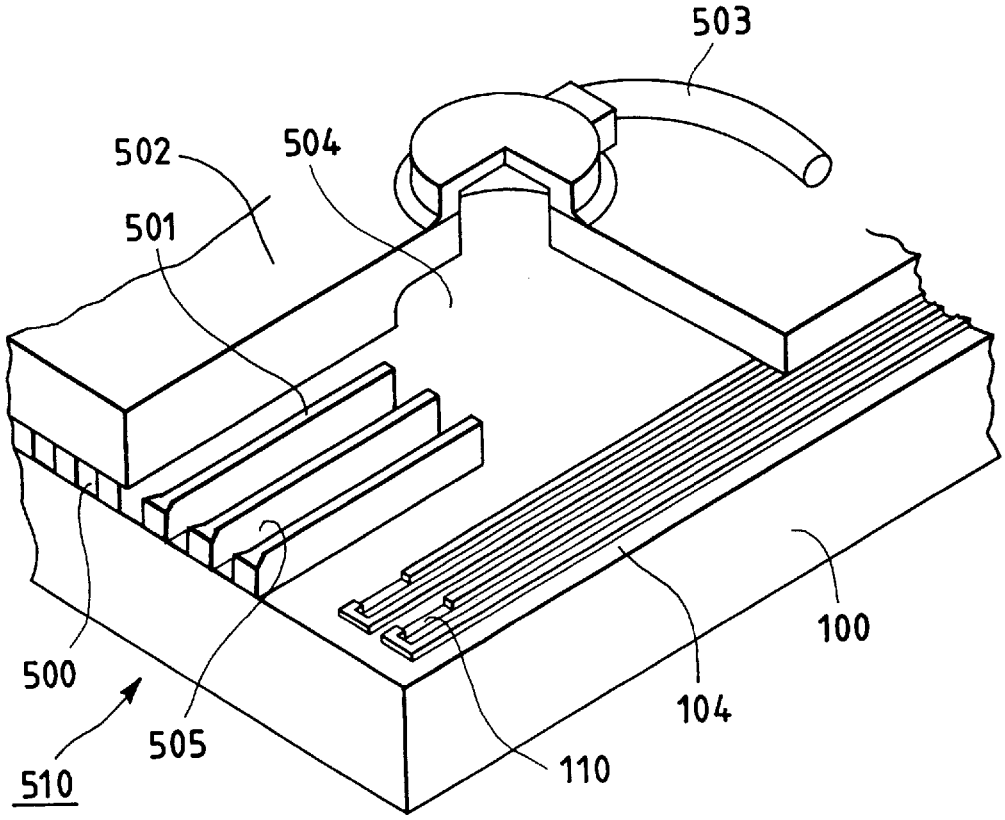
FIG. 3 is a perspective view showing an external constitution of an ink jet recording head according to the present invention.

On the element substrate 100 thus constituted, a liquid channel wall member 501 made of photosensitive resin to form the liquid channels 505 in communication to a plurality of discharge orifices 500, and a ceiling plate 502 having an ink supply opening 503 are attached, as shown in FIG. 3, whereby a recording head 510 of the ink jet recording system can be fabricated. In this case, the ink poured through the ink supply opening 503 is stored within a common liquid chamber 504 and supplied therefrom to each liquid channel 505, wherein the ink is discharged through the discharge orifices 500 by driving the heating portion 110 in this state.

A manufacturing process of a recording head 510 in a first example will be described below.

(1) After a roughly 8000 Å thick silicon oxide film was formed on the surface of a P-type silicon substrate 1 (impurity density of roughly $1\times10^{12}$ to $1\times10^{16}$ $cm^{-3}$), the silicon oxide film on a portion for forming an N-type collector buried region 2 of each cell was removed through the photolithography process. After forming a silicon oxide film, and N-type impurities (e.g., P, As) were ion implanted, the N-type collector buried region 2 having an impurity density of $1\times10^{18}$ $cm^{-3}$ or greater was formed 2 to 6 μm thick by thermal diffusion, resulting in the sheet resistance being made as low as 30Ω/□ or less. Subsequently, after the silicon oxide film was removed in the region for forming a P-type isolation buried region 3 to form an approximately 1000 Å thick silicon oxide film, and then P-type impurities were ion implanted, the P-type isolation buried region 3 having an impurity density of $1\times10^{15}$ to $1\times10^{17}$ $cm^{-3}$ or greater was formed by thermal diffusion (see FIG. 4).

Figure 5:
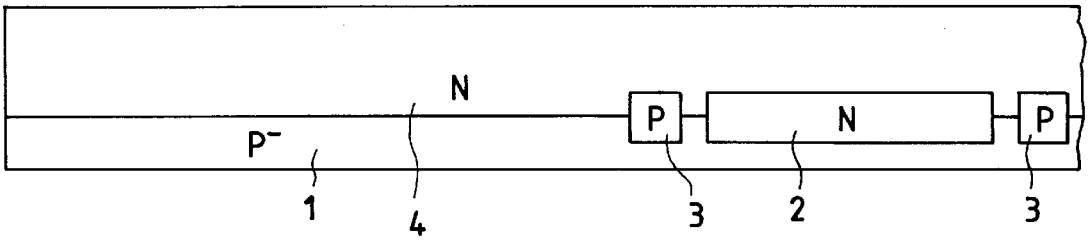
FIG. 5 is a typical cross-sectional view for exemplifying a manufacturing method of an ink jet head in an example 1 of the invention.

(2) After forming a silicon oxide film over the entire surface, an N-type epitaxial region 4 (impurity density of about $1\times10^{13}$ to $1\times10^{15}$ $cm^{-3}$) was epitaxially grown about 5 to 20 μm thick (see FIG. 5).

Figure 6:
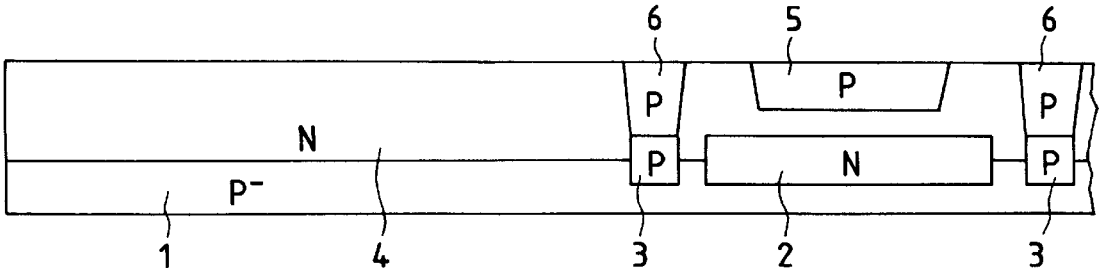
FIG. 6 is a typical cross-sectional view for exemplifying the manufacturing method of the ink jet head in the example 1 of the invention.

(3) Then, an approximately 1000 Å thick silicon oxide film was formed on the surface of the N-type epitaxial region 4, a resist was applied thereon, the patterning was made, and P-type impurities were ion implanted into a portion for forming a low density P-type base region 5. After removal of the resist, the low density P-type base region 5 (impurity density of about $1\times10^{14}$ to $1\times10^{17}$ $cm^{-3}$) was formed about 5 to 10 μm thick by thermal diffusion. Thereafter, the silicon oxide film was removed from the entire surface again, and after an approximately 8000 Å thick silicon oxide film was further formed, the silicon oxide film was removed on a portion for forming a P-type isolation region 6, a BSG film was deposited over the entire surface by CVD, and a P-type isolation region 6 (impurity density of about $1\times10^{18}$ to $1\times10^{20}$ $cm^{-3}$) was further formed about 10 μm thick by thermal diffusion to reach the P-type isolation buried region 3. Herein, it is also possible to form the P-type isolation region 6 using $BBr_3$ as a diffusion source (see FIG. 6).

Figure 8:
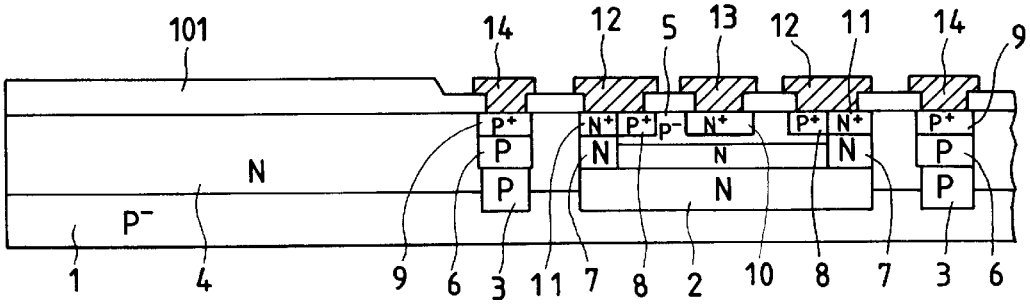
FIG. 8 is a typical cross-sectional view for exemplifying the manufacturing method of the ink jet head in the example 1 of the invention.

(4) After removal of the BSG film, an approximately 8000 Å thick silicon oxide film was formed, and after the silicon oxide film was removed on a portion for forming an N-type collector region 7, the N-type collector region 7 (impurity density of about $1\times10^{18}$ to $1\times10^{20}$ $cm^{-3}$) was formed by N-type solid phase diffusion or ion implantation of phosphorus ions, or by thermal diffusion, to reach the collector buried region 5 or have the sheet resistance as low as 10Ω/□ or less. Here, the thickness of the N-type collector region 7 was 10 μm. Subsequently, after an approximately 12500 Å thick silicon oxide film was formed, and a heat storage layer 101 (see FIG. 8) was formed, the silicon oxide film in the cell region was selectively removed to form an approximately 2000 Å thick silicon oxide film.

Figure 7:
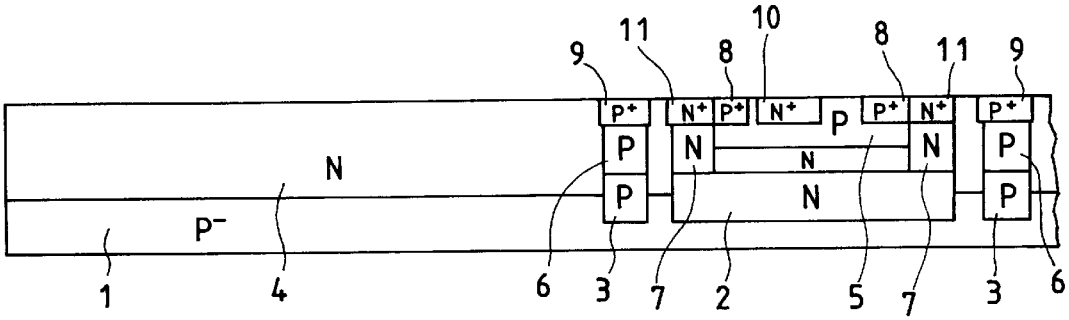
FIG. 7 is a typical cross-sectional view for exemplifying the manufacturing method of the ink jet head in the example 1 of the invention.

The patterning of a resist was made, and P-type impurities were implanted into a portion for forming a high density base region 8 and a high density isolation region 9. After removal of the resist, the silicon oxide film was removed in a region for forming an N-type emitter region 10 and a high density N-type collector region 11, a thermal oxide film was formed over the entire surface, and after N-type impurities were implanted, the N-type emitter region 10 and the high density N-type collector region 11 were formed at the same time by thermal diffusion. Note that the thickness of the N-type emitter region 10 and that of the high density N-type collector region 11 were 1.0 μm or less, respectively, and the density of impurities was made roughly from $1\times10^{18}$ to $1\times10^{20}$ $cm^{-3}$ (see FIG. 7).

(5) Moreover, after removing the silicon oxide film on the connecting portion of partial electrode, Al was deposited over the entire surface, and Al was removed except for the partial electrode region.

(6) And an approximately 0.6 to 1.0 μm thick $SiO_2$ film which is an interlayer film 102 having a function as the heat storage layer was formed over the entire surface by sputtering. This interlayer film 102 may be made by CVD. Also, it is not limited to the $SiO_2$ film, but may be an SiO film or SiN film.

Figure 9:
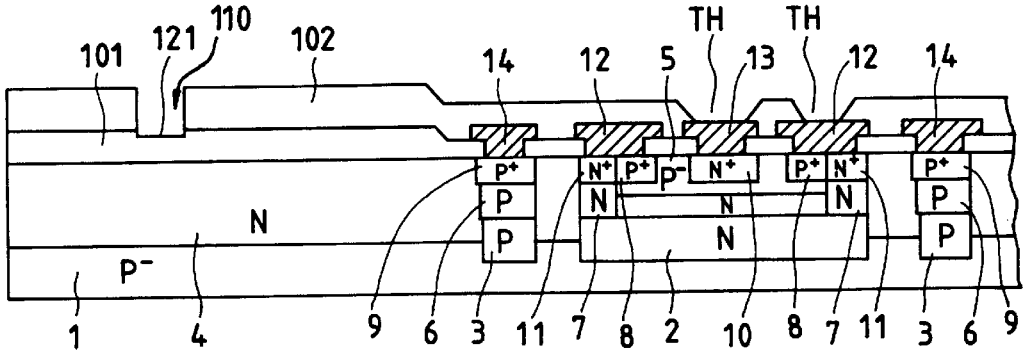
FIG. 9 is a typical cross-sectional view for exemplifying the manufacturing method of the ink jet head in the example 1 of the invention.

Then, to make the electrical connection, a part of the interlayer film 102 above the emitter region and the base/collector region was opened by photolithography to form a through hole TH. At the same time, the patterning was made on a portion serving as the heater to form grooves 121 having a width of 30 μm and a length of 120 μm. The heating portion 110 is located above these grooves (see FIG. 9).

(7) Next, TaN as the heating resistive layer 103 was deposited approximately 1000 Å thick on the interlayer film 102, an electrode 13 and electrodes 12 located above the emitter region and the base/collector region to effect the electrical connection, and a groove 121 of a portion serving as the heater which is an electricity-heat conversion element.

Figure 13:
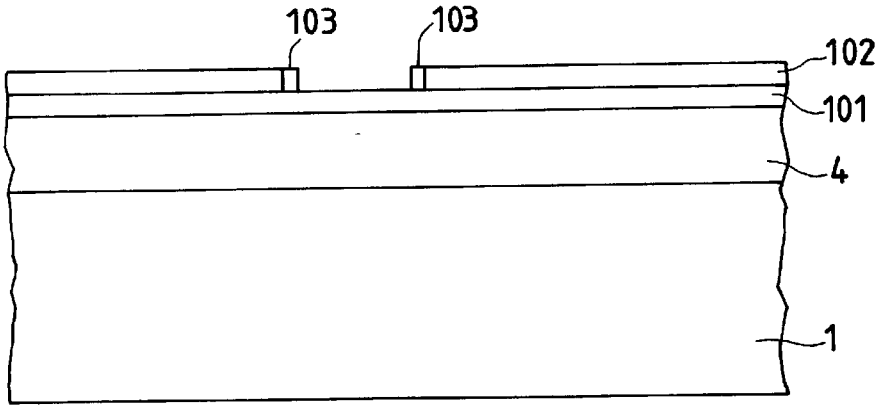
FIG. 13 is a cross-sectional view showing the state of a heating portion in a manufacturing process of the ink jet head in the example 1 of the invention.

(8) On the heating resistive layer 103 was deposited a roughly 7000 Å thick layer made of Al as a pair of wiring electrodes 104 for electricity-heat conversion element, and a cathode wiring electrode 104 and an anode wiring electrode 109 for diode, and the Al patterning was first made. Then, the heater material was etched under a mask of Al. In this case, because Al as the mask material is etched at the same time but TaN to be etched is as thin as 1000 Å, Al will not be entirely etched, wherein after the etching of TaN was ended, Al was left behind about 5000 Å thick (see FIG. 10). Also, the heater material remained only on the side walls of grooves as shown in FIG. 13 (cross-sectional view of heater portion).

(9) Thereafter, $SiO_2$ film 105 as the protective layer of electricity-heat conversion element and the insulating layer between Al wirings was deposited about 6000 Å thick by sputtering or CVD, and then Ta as the protective layer 106 for the anticavitation was deposited about 2000 Å thick on the heating portion of electricity-heat converter.

Figure 11:
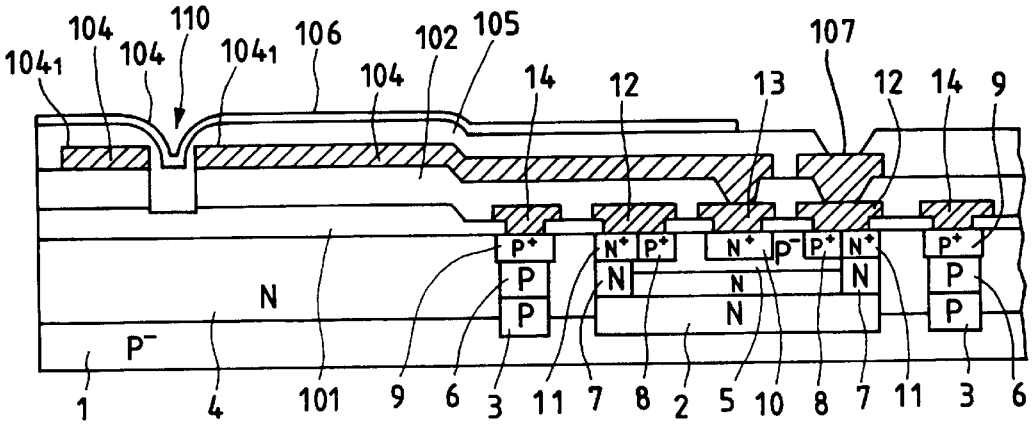
FIG. 11 is a typical cross-sectional view for exemplifying the manufacturing method of the ink jet head in the example 1 of the invention.

(10) By removing partially the electricity-heat conversion elements, Ta and $SiO_2$ film 105 as above made, a bonding pad 107 was formed. Note that the protective film 105 may be SiON or SiN, in addition to $SiO_2$ (see FIG. 11).

Figure 12:
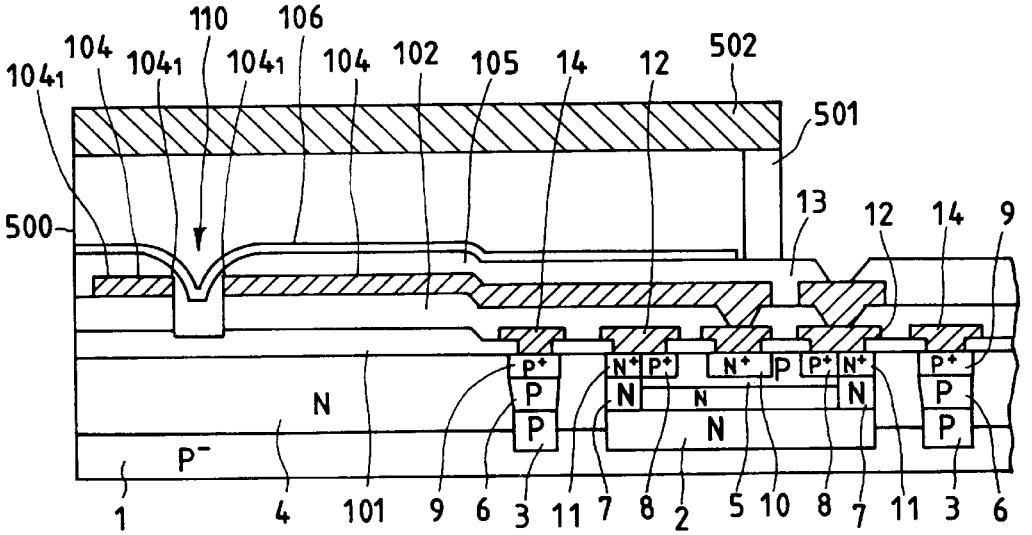
FIG. 12 is a typical cross-sectional view for exemplifying the manufacturing method of the ink jet head in the example 1 of the invention.
Figure 14:
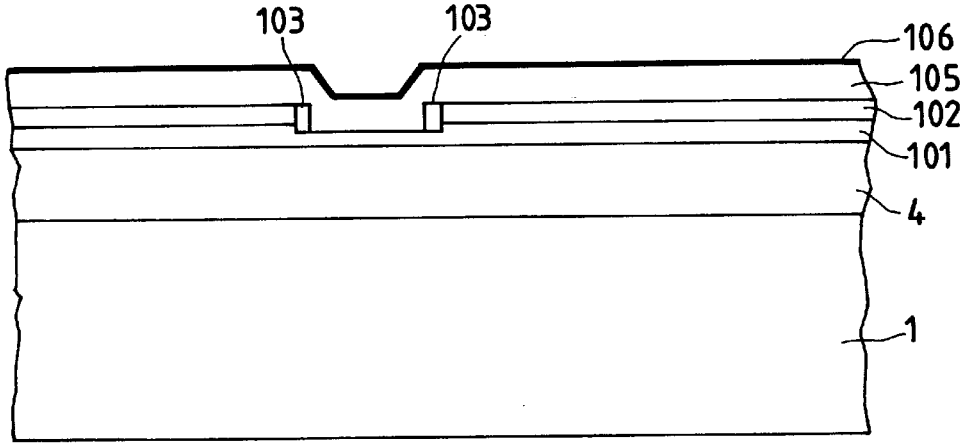
FIG. 14 is a cross-sectional view showing the state of the heating portion in the manufacturing process of the ink jet head in the example 1 of the invention.

Also, FIG. 14 shows a cross-sectional view of the heater portion,

(11) Next, a liquid channel wall member and a ceiling plate 502 for forming an ink discharge portion 500 were disposed on the element substrate having semiconductor devices, whereby a recording head having ink liquid channels formed inside was fabricated (see FIG. 12).

In this example, the electricity-heat conversion elements for discharging the ink and the grooves constituting the ink flow passages are formed on the element substrate provided with the electricity-heat conversion elements. Therefore, the heat quantity conducting to the function elements can be reduced owing to the increased area of the wall in contact with the ink, and the flow passages can be formed correctly. In this example, the heater is formed only on the side wall of the groove 121 of the interlayer film 102, and the calorific value can be effectively used without any heat leaking away to the silicon substrate. Also, the heat storage layer 101 can be made thin, and the heat processing of long time during the process in depositing the heat storage layer can be shortened.

Also, the heater as wide as the interlayer film 102 can be made in self-alignment. The heater can be made shorter in size corresponding to the narrower line width, in obtaining the calorific value comparative to that of the conventional heater, so that the size of element can be reduced, while the high speed operation of the element can be effected as the heating center of heater becomes closer to the top end of the nozzle.

Figure 15:
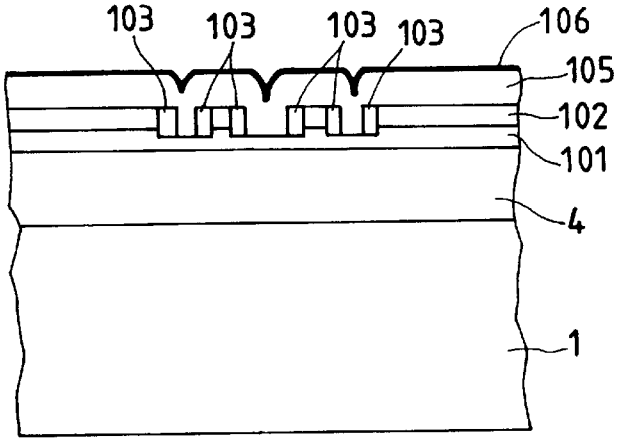
FIG. 15 is a view showing another example of a heating portion of an ink jet head according to the present invention.
Figure 16:
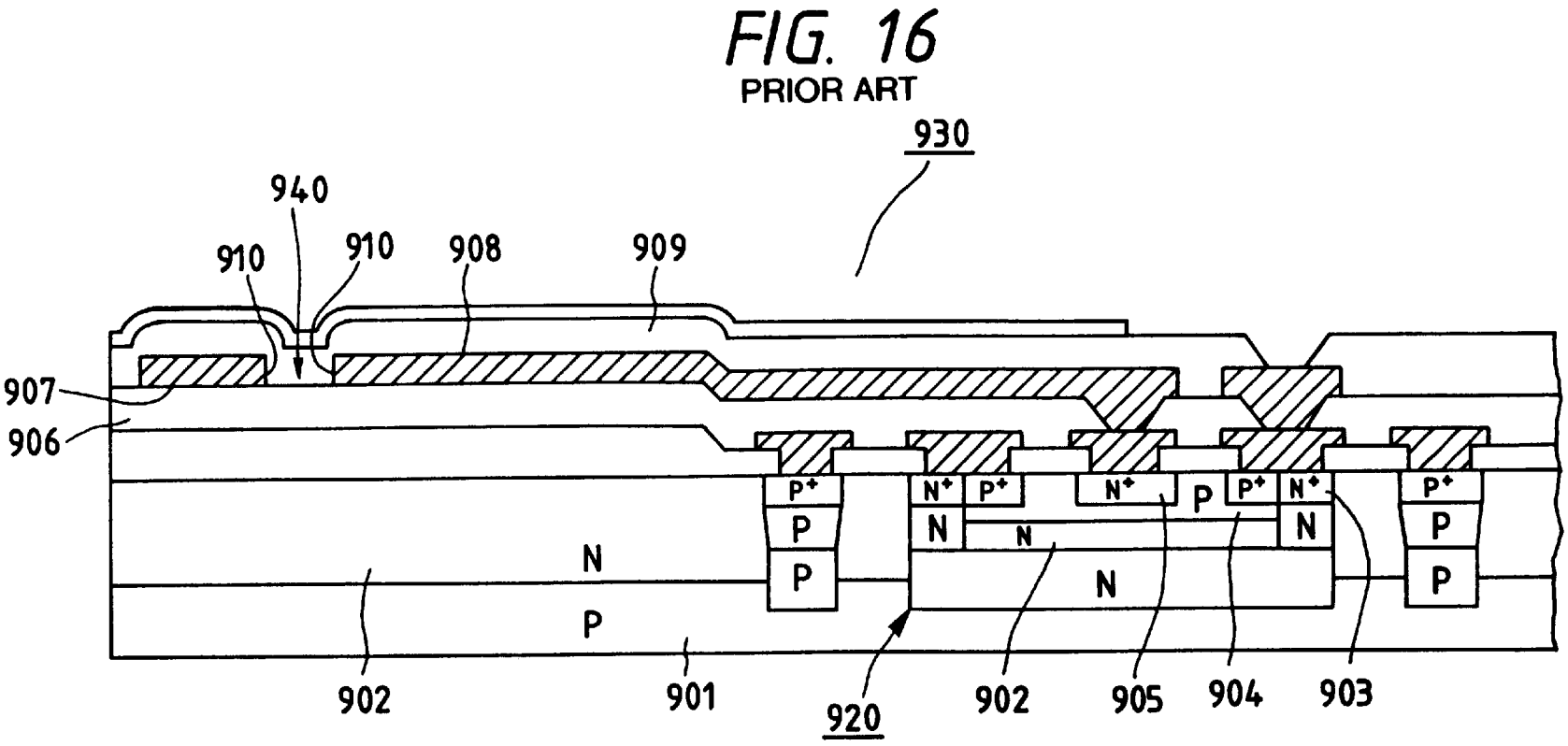
FIG. 16 PRIOR ART
FIG. 16 is a typical cross-sectional view showing a part of a conventional ink jet head substrate.

While only one groove is provided in this example, a plurality of grooves can be arranged to increase the calorific value (FIG. 15).

Another manufacturing method of an ink jet head which is different from that of the above example will be described below.

Figure 4:
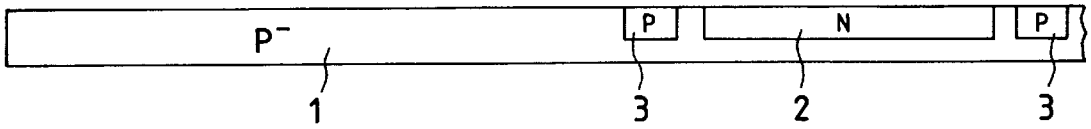
FIG. 4 is a typical cross-sectional view for exemplifying a manufacturing method of an ink jet head according to the invention.

(1) An initial process in manufacturing an element substrate is identical to that as shown in FIG. 4, and will not described any more.

Figure 17:
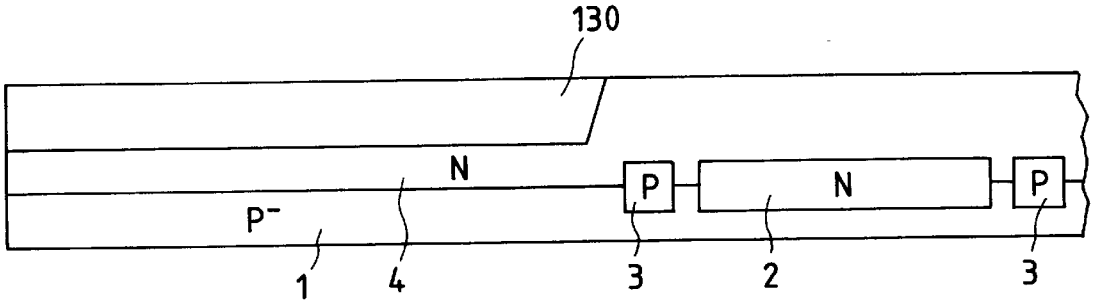
FIG. 17 is a typical cross-sectional view for exemplifying a manufacturing method of an ink jet head in an example 2 of the invention.

(2) After forming a silicon oxide film over the entire surface, an N-type epitaxial region 4 (impurity density of about $1\times10^{13}$ to $1\times10^{15}$ $cm^{-3}$) was epitaxially grown about 5 to 20 $\mu$m thick. Then, after an approximately 8000 Å thick silicon oxide film was formed, the silicon oxide film was removed in a width (about +10 $\mu$m) slightly greater than that of a heater member other than a driving element of each cell. Thereafter, the anisotropic etching of a substrate was performed using an alkaline etching solution (e.g., TMAH). Thereby, a V-shaped groove having a width of about 30 $\mu$m and a depth of about 30 $\mu$m was formed on the substrate. Then, the silicon oxide film was removed over the entire surface (FIG. 17).

Figure 18:
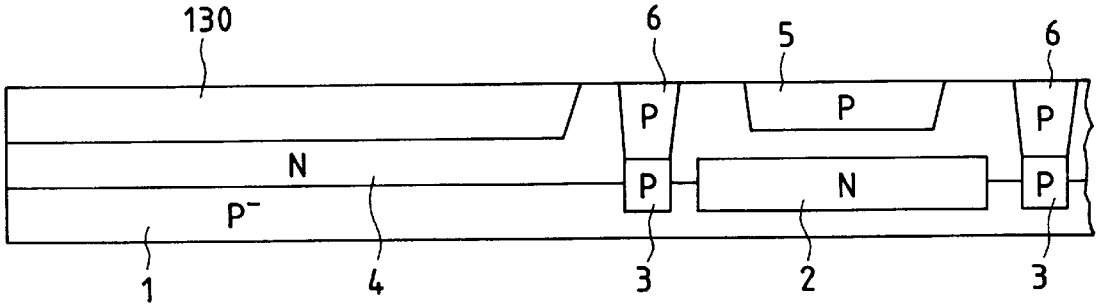
FIG. 18 is a typical cross-sectional view for exemplifying the manufacturing method of the ink jet head in the example 2 of the invention.

(3) Then, an approximately 1000 Å thick silicon oxide film was formed on the surface of the N-type epitaxial region 4, a resist was applied thereon, the patterning was made, and P-type impurities were ion implanted into a portion for forming a low density P-type base region 5. After removal of the resist, the low density P-type base region 5 (impurity density of about $1\times10^{14}$ to $1\times10^{17}$ $cm^{-3}$) was formed about 5 to 10 $\mu$m thick by thermal diffusion. Thereafter, the silicon oxide film was removed from the entire surface again, and after an approximately 8000 Å thick silicon oxide film was further formed, the silicon oxide film was removed on a portion for forming a P-type isolation region 6, a BSG film was deposited over the entire surface by CVD, and a P-type isolation region 6 (impurity density of about $1\times10^{18}$ to $1\times10^{20}$ $cm^{-3}$) was further formed about 10 $\mu$m thick by thermal diffusion to reach the P-type isolation buried region 3. Herein, it is also possible to form the P-type isolation region 6 using $BBr_3$ as a diffusion source (see FIG. 18).

Figure 20:
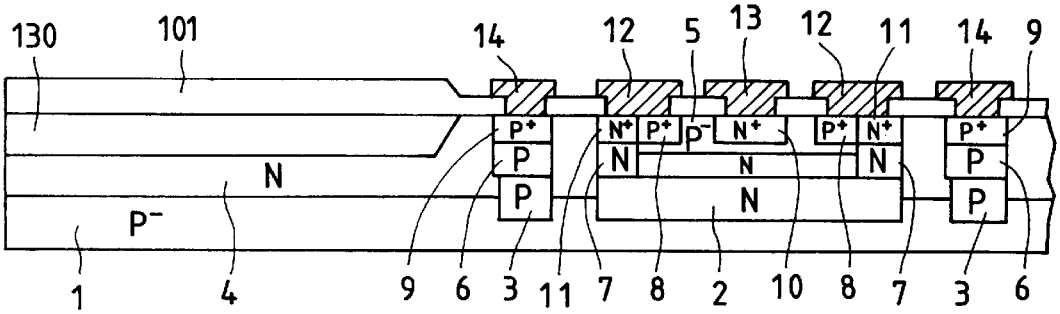
FIG. 20 is a typical cross-sectional view for exemplifying the manufacturing method of the ink jet head in the example 2 of the invention.

(4) After removal of the BSG film, an approximately 8000 Å thick silicon oxide film was formed, and after the silicon oxide film was removed on a portion for forming an N-type collector region 7, the N-type collector region 7 (impurity density of about $1\times10^{18}$ to $1\times10^{20}$ $cm^{-3}$) was formed by N-type solid phase diffusion or ion implantation of phosphorus ions, or by thermal diffusion, to reach the collector buried region 5 or have the sheet resistance as low as 10Ω/□ or less. Here, the thickness of the N-type collector region 7 was about 10 $\mu$m. Subsequently, after an approximately 12500 Å thick silicon oxide film was formed, and a heat storage layer 101 (see FIG. 20) was formed, the silicon oxide film in the cell region was selectively removed to form an approximately 2000 Å thick silicon oxide film.

Figure 19:
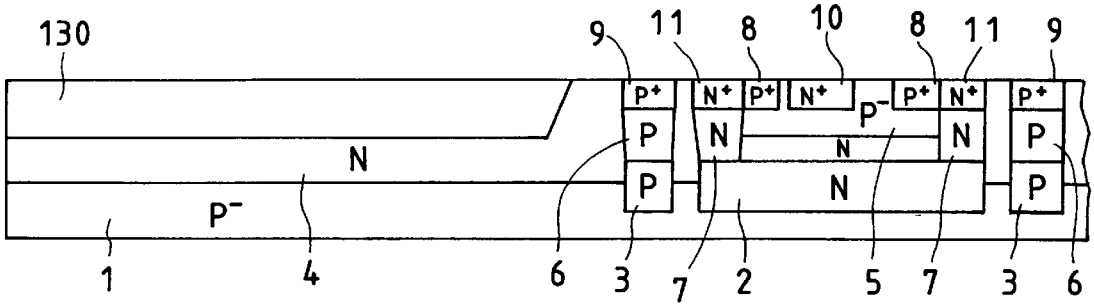
FIG. 19 is a typical cross-sectional view for exemplifying the manufacturing method of the ink jet head in the example 2 of the invention.

The patterning of a resist was made, and P-type impurities were implanted into a portion for forming a high density base region 8 and a high density isolation region 9. After removal of the resist, the silicon oxide film was removed in a region for forming an N-type emitter region 10 and a high density N-type collector region 11, and a thermal oxide film was formed over the entire surface, and after N-type impurities were implanted, the N-type emitter region 10 and the high density N-type collector region 11 were formed at the same time by thermal diffusion. Note that the thickness of the N-type emitter region 10 and that of the high density N-type collector region 11 were 1.0 $\mu$m or less, respectively, and the density of impurities was made roughly from $1\times10^{18}$ to $1\times10^{20}$ $cm^{-3}$ (see FIG. 19).

(5) Moreover, after removing the silicon oxide film on the connecting portion of partial electrode, Al was deposited over the entire surface, and Al was removed except for the partial electrode region.

(6) And an approximately 0.6 to 1.0 $\mu$m thick $SiO_2$ film which is an interlayer film 102 having a function as the heat storage layer was formed over the entire surface by sputtering. This interlayer film 102 may be made by CVD. Also, it is not limited to the $SiO_2$ film, but may be an SiO film or SiN film.

Figure 21:
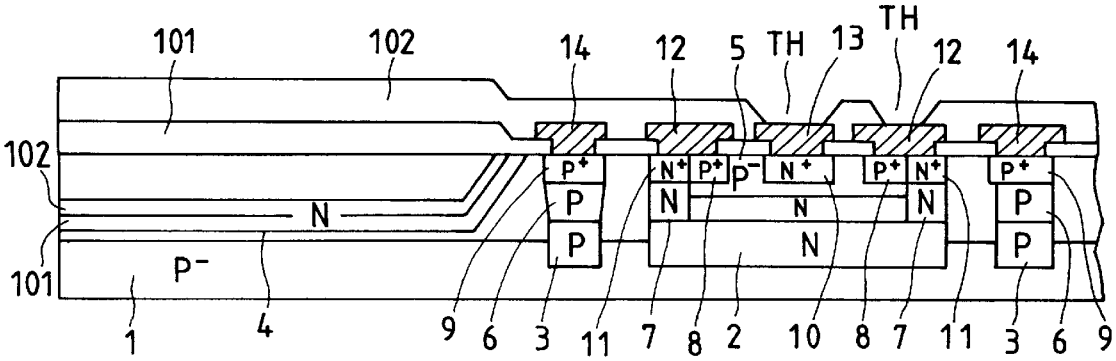
FIG. 21 is a typical cross-sectional view for exemplifying the manufacturing method of the ink jet head in the example 2 of the invention.

Then, to make the electrical connection, a part of the interlayer film 102 above the emitter region and the base/collector region was opened by photolithography to form a through hole TH (FIG. 21).

(7) Next, TaN as the heating resistive layer 103 was deposited, through a through hole TH, approximately 1000 Å thick on the interlayer film 102, an electrodes 13 and an electrode 12 located above the emitter region and the base/collector region to effect the electrical connection.

Figure 22:
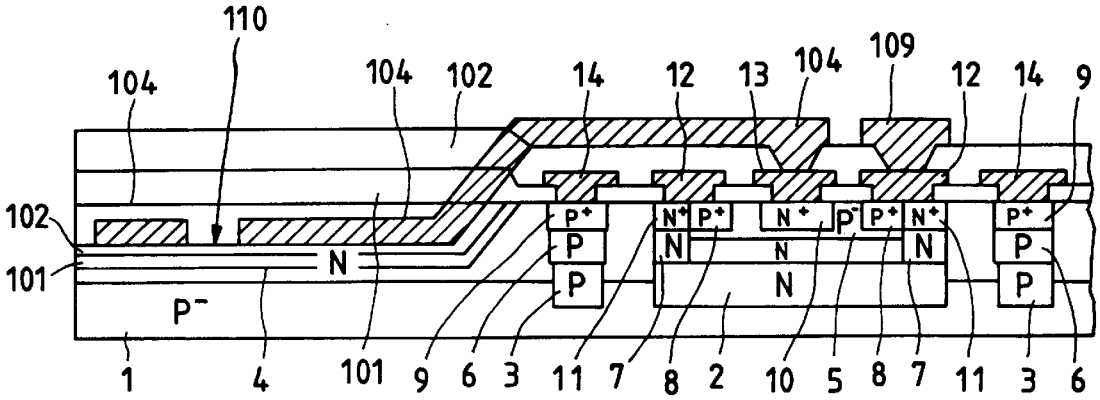
FIG. 22 is a typical cross-sectional view for exemplifying the manufacturing method of the ink jet head in the example 2 of the invention.

(8) On the heating resistive layer 103 was deposited a roughly 5000 Å thick layer made of Al as a pair of wiring electrodes 104 for electricity-heat conversion element, and a cathode wiring electrode 104 and an anode wiring electrode 109 for diode, and the patterning for Al and TaN (heating resistive layer 103) was made to form the electricity-heat conversion elements and other wirings at the same time. Herein, the patterning of Al is identical to that of the previous method (see FIG. 22).

(9) Thereafter, $SiO_2$ film 105 as the protective layer of electricity-heat conversion element and the insulating layer between Al wirings was deposited about 6000 Å thick by sputtering or CVD, and then Ta as the protective layer 106 for the anticavitation was deposited about 2000 Å thick on the heating portion of electricity-heat converter.

Figure 23:
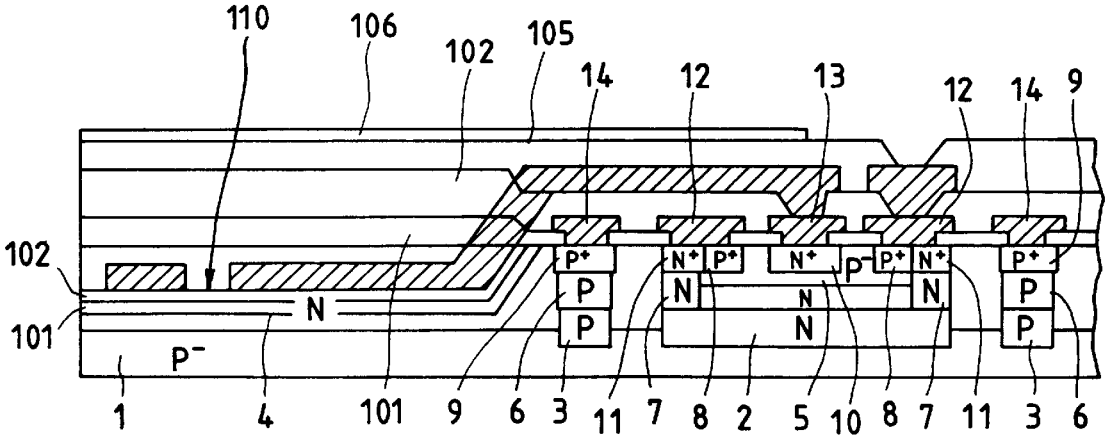
FIG. 23 is a typical cross-sectional view for exemplifying the manufacturing method of the ink jet head in the example 2 of the invention.

(10) By removing partially the electricity-heat conversion elements, Ta and $SiO_2$ film 105 as above made, a bonding pad 107 was formed. Note that the protective film 105 may be SiON or SiN, in addition to $SiO_2$ (see FIG. 23).

Figure 24:
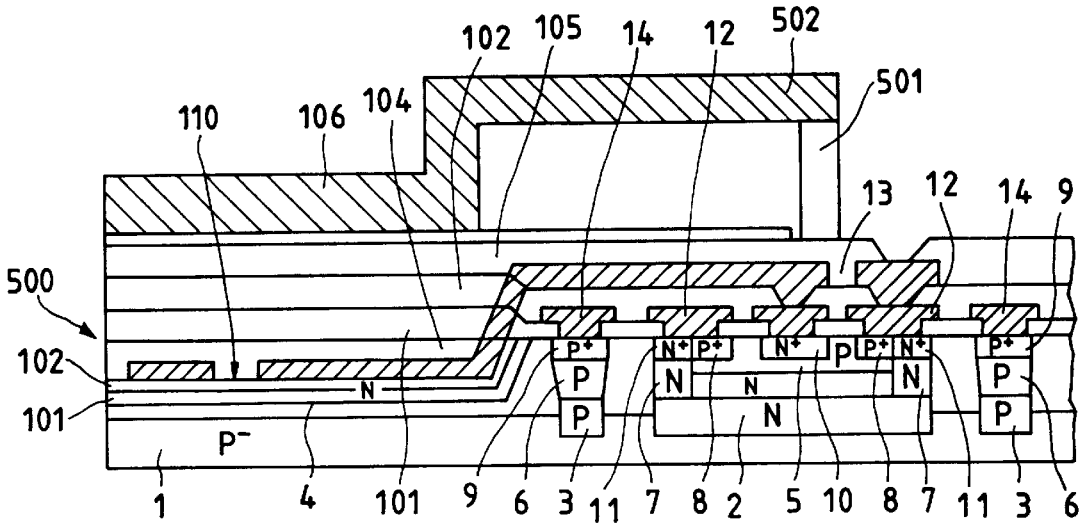
FIG. 24 is a typical cross-sectional view for exemplifying the manufacturing method of the ink jet head in the example 2 of the invention.

(11) Next, a liquid channel wall member and a ceiling plate 502 for forming an ink discharge portion 500 were disposed on the element substrate having semiconductor devices, whereby a recording head having ink liquid channels formed inside was fabricated (see FIG. 24).

Figure 39:
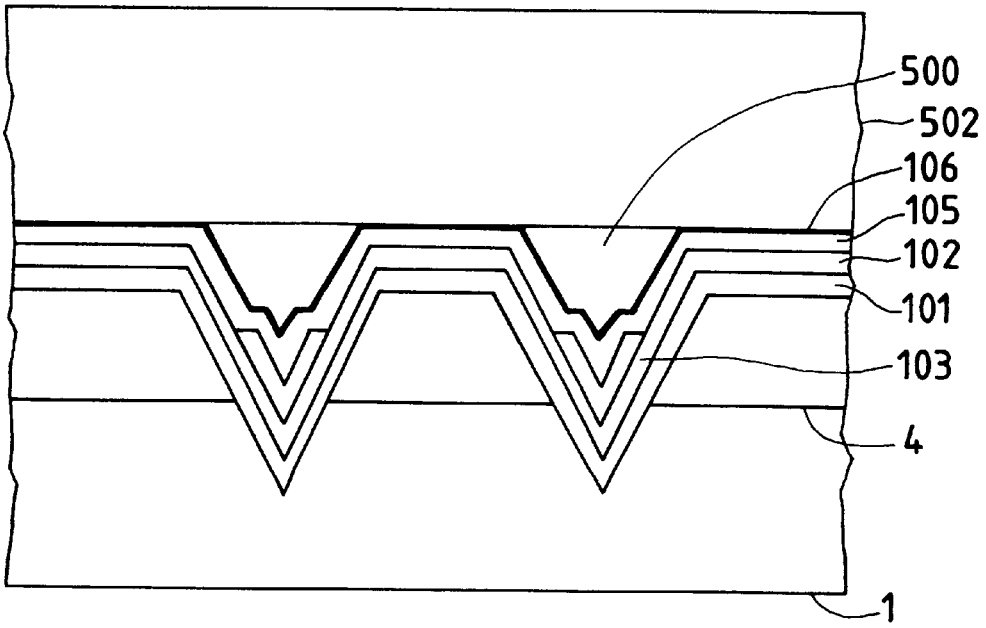
FIG. 39 is a cross-sectional view of a heater portion of a recording head in the example 2 of the invention.

FIG. 39 shows a cross-sectional view of the heating portion 110.

In this example, the ink nozzles can be formed in self-alignment by placing a flat ceiling plate on the heater portion which is formed within the V-shaped groove. Therefore, an alignment process between the ink nozzle and the heater portion is unnecessary, so that the shortened process and the improved yield have been attained. Since the ink discharge portion is formed within the silicon substrate using a photolithography technique of semiconductor, the nozzles of any dimension can be formed simply at high precision.

While in this example the V-shaped groove is formed using an anisotropic etching of silicon, it will be appreciated that the groove is not specifically limited to the V shape, but the isotropic or vertical groove by normal wet etching may be formed with the same effects.

Another manufacturing method of an ink jet head in a third example will be described below.

(1) An initial process in manufacturing an element substrate is identical to that as shown in FIG. 4, and will not described any more.

Figure 25:
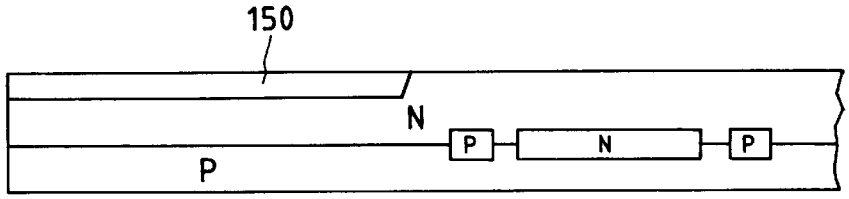
FIG. 25 is a typical cross-sectional view for exemplifying a manufacturing method of an ink jet head in an example 3 of the invention.

(2) After forming a silicon oxide film over the entire surface, an N-type epitaxial region 4 (impurity density of about $1\times10^{13}$ to $1\times10^{15}$ $cm^{-3}$) was epitaxially grown about 5 to 20 $\mu$m thick. Then, after an approximately 8000 Å thick silicon oxide film was formed, the silicon oxide film was removed in a width (about +10 $\mu$m) slightly greater than that of a heater member other than a driving element of each cell. Thereafter, the etching of silicon was conducted vertically 25 $\mu$m thick (see FIG. 25). A groove 150 was formed.

Figure 26:
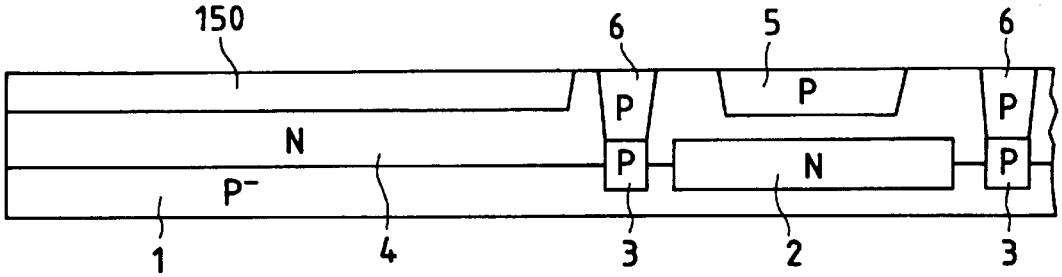
FIG. 26 is a typical cross-sectional view for exemplifying the manufacturing method of the ink jet head in the example 3 of the invention.

(3) Then, an approximately 1000 Å thick silicon oxide film was formed on the surface of the N-type epitaxial region 4, a resist was applied thereon, the patterning was made, and P-type impurities were ion implanted into a portion for forming a low density P-type base region 5. After removal of the resist, the low density P-type base region 5 (impurity density of about $1\times10^{14}$ to $1\times10^{17}$ $cm^{-3}$) was formed about 5 to 10 $\mu$m thick by thermal diffusion. Thereafter, the silicon oxide film was removed from the entire surface again, and after an approximately 8000 Å thick silicon oxide film was further formed, the silicon oxide film was removed on a portion for forming a P-type isolation region 6, a BSG film was deposited over the entire surface by CVD, and a P-type isolation region 6 (impurity density of about $1\times10^{18}$ to $1\times10^{20}$ $cm^{-3}$) was further formed about 10 $\mu$m thick by thermal diffusion to reach the P-type isolation buried region 3. Herein, it is also possible to form the P-type isolation region 6 using $BBr_3$ as a diffusion source (see FIG. 26).

Figure 28:
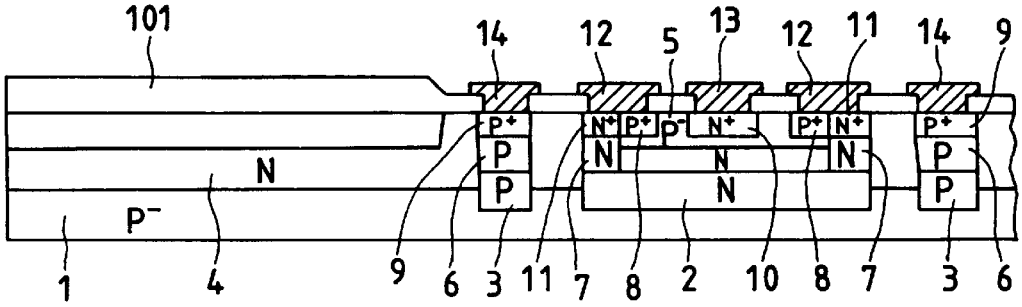
FIG. 28 is a typical cross-sectional view for exemplifying the manufacturing method of the ink jet head in the example 3 of the invention.
Figure 29:
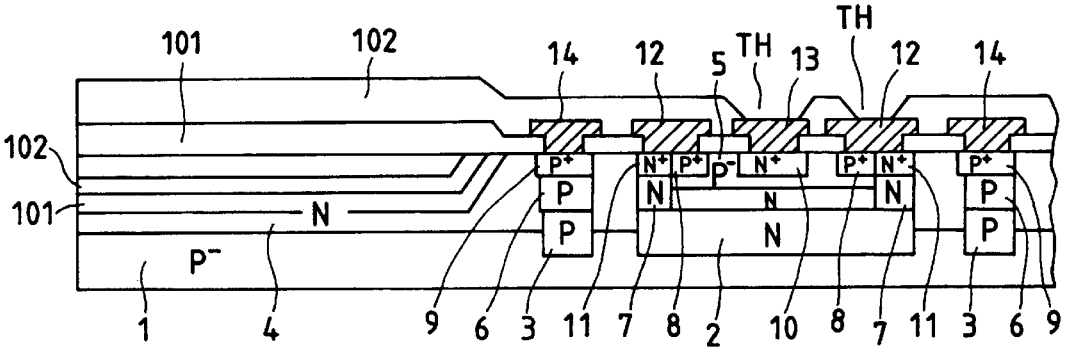
FIG. 29 is a typical cross-sectional view for exemplifying the manufacturing method of the ink jet head in the example 3 of the invention.

(4) After removal of the BSG film, an approximately 8000 Å thick silicon oxide film was formed, and after the silicon oxide film was removed on a portion for forming an N-type collector region 7, the N-type collector region 7 (impurity density of about $1\times10^{18}$ to $1\times10^{20}$ $cm^{-3}$) was formed by N-type solid phase diffusion or ion implantation of phosphorus ions, or by thermal diffusion, to reach the collector buried region 5 or have the sheet resistance as low as 10Ω/□ or less. Here, the thickness of the N-type collector region 7 was about 10 $\mu$m. Subsequently, after an approximately 12500 Å thick silicon oxide film was formed, and a heat storage layer 101 (see FIG. 28) was formed, the silicon oxide film in the cell region was selectively removed to form an approximately 2000 Å thick silicon oxide film.

Figure 27:
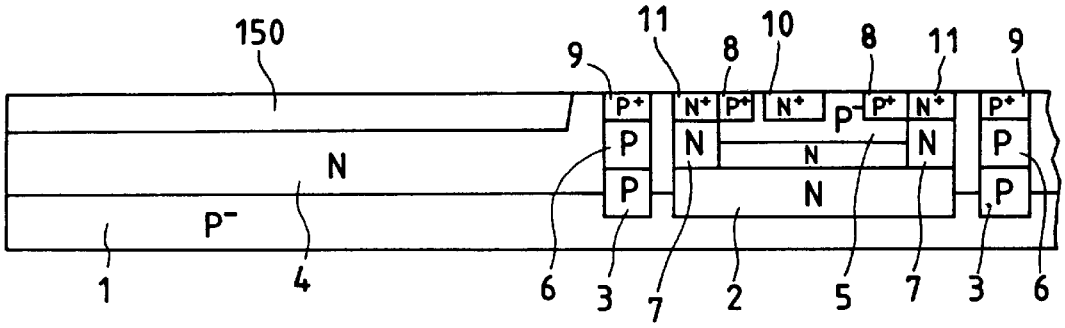
FIG. 27 is a typical cross-sectional view for exemplifying the manufacturing method of the ink jet head in the example 3 of the invention.

The patterning of a resist was made, and P-type impurities were implanted into a portion for forming a high density base region 8 and a high density isolation region 9. After removal of the resist, the silicon oxide film was removed in a region for forming an N-type emitter region 10 and a high density N-type collector region 11, and a thermal oxide film was formed over the entire surface, and after N-type impurities were implanted, the N-type emitter region 10 and the high density N-type collector region 11 were formed by thermal diffusion at the same time. Note that the thickness of the N-type emitter region 10 and that of the high density N-type collector region 11 were 1.0 $\mu$m or less, respectively, and the density of impurities was made roughly from $1\times10^{18}$ to $1\times10^{20}$ $cm^{-3}$ (see FIG. 27).

(5) Moreover, after removing the silicon oxide film on the connecting portion of partial electrode, Al was deposited over the entire surface, and Al was removed except for the partial electrode region.

(6) And an approximately 0.6 to 1.0 $\mu$m thick $SiO_2$ film which is an interlayer film 102 having a function as the heat storage layer was formed over the entire surface by sputtering. This interlayer film 102 may be made by CVD. Also, it is not limited to the $SiO_2$ film, but may be an $SiO_2$ film or SiN film.

Figure 30:
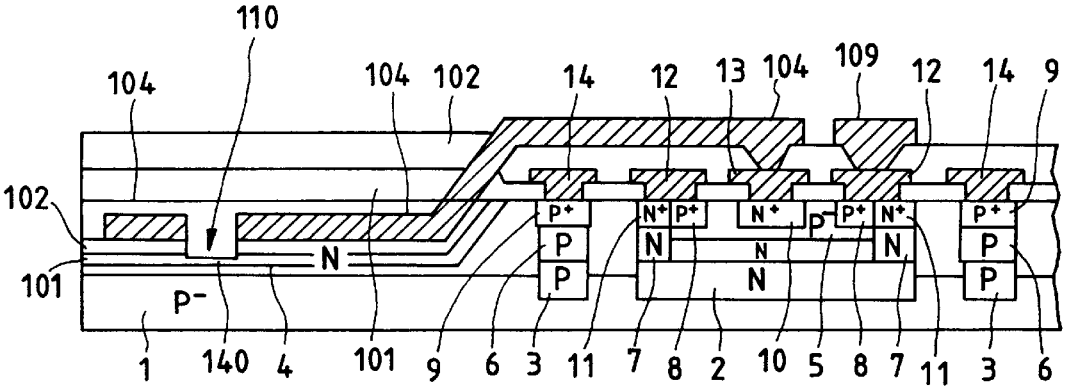
FIG. 30 is a typical cross-sectional view for exemplifying the manufacturing method of the ink jet head in the example 3 of the invention.

Then, to make the electrical connection, a part of the interlayer film 102 above the emitter region and the base/collector region was opened by photolithography to form a through hole TH. At the same time, the patterning was performed on a portion serving as the heater to form a groove 140 having a width of 30 $\mu$m and a length of 120 $\mu$m (FIG. 30).

(7) Next, TaN as the heating resistive layer 103 was deposited approximately 1000 Å thick on the interlayer film 102, an electrode 13 and an electrode 12 located above the emitter region and the base/collector region to effect the electrical connection, and the groove 140 in the portion serving as the heater.

Figure 10:
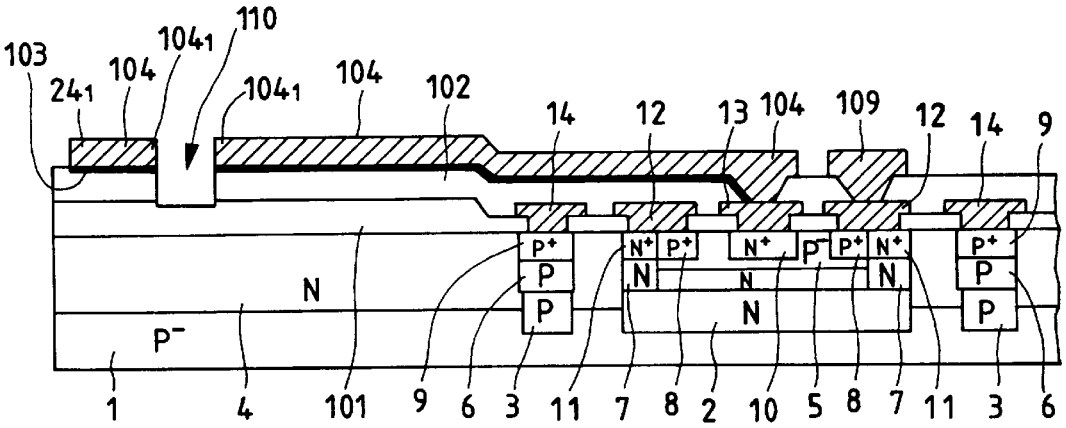
FIG. 10 is a typical cross-sectional view for exemplifying the manufacturing method of the ink jet head in the example 1 of the invention.

(8) On the heating resistive layer 103 was deposited a roughly 7000 Å thick layer made of Al as a pair of wiring electrodes 104 for electricity-heat conversion element, and a cathode wiring electrode 104 and an anode wiring electrode 109 for diode, and the patterning for Al was first made. Then, the heater material was etched under a mask of Al. In this case, because Al as the mask material is etched as well but TaN to be etched is as thin as 1000 Å, Al will not be entirely etched, wherein after the etching of TaN was ended, Al was left behind about 5000 Å thick. Also, the heater material remained only on the side walls of grooves as shown in FIG. 10.

(9) Thereafter, $SiO_2$ film 105 as the protective layer of electricity-heat conversion element and the insulating layer between Al wirings was deposited about 6000 Å thick by sputtering or CVD, and then Ta as the protective layer 106 for the anticavitation was deposited about 2000 Å thick on the heating portion of electricity-heat converter.

Figure 31:
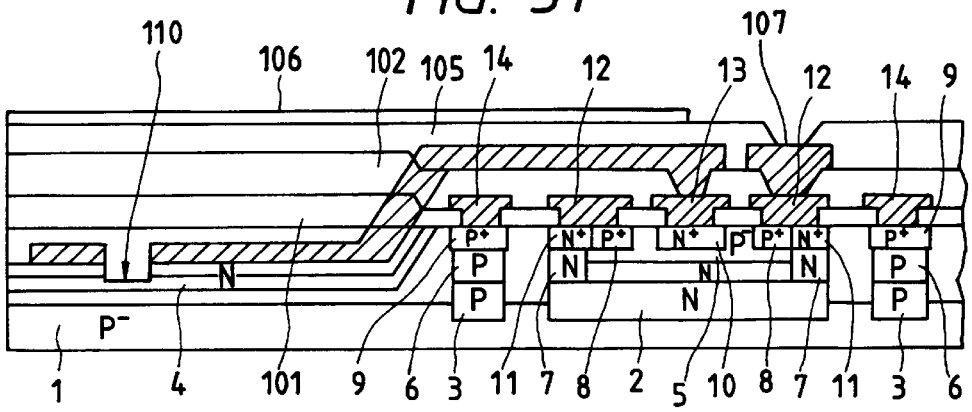
FIG. 31 is a typical cross-sectional view for exemplifying the manufacturing method of the ink jet head in the example 3 of the invention.

(10) By removing partially the electricity-heat conversion elements, Ta and $SiO_2$ film 105 as above made, a bonding pad 107 was formed. Note that the protective film 105 may be SiON or SiN, in addition to $SiO_2$ (see FIG. 31).

Figure 32:
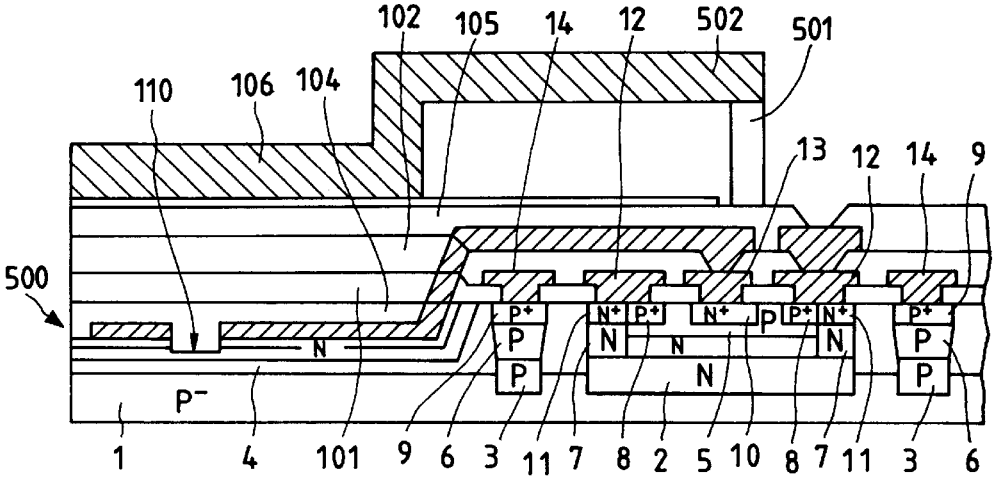
FIG. 32 is a typical cross-sectional view for exemplifying the manufacturing method of the ink jet head in the example 3 of the invention.

(11) Next, a liquid channel wall member 501 and a ceiling plate 502 for forming an ink discharge portion 500 were disposed on the element substrate having semiconductor devices, whereby a recording head having ink liquid channels formed inside was fabricated (see FIG. 32).

Figure 40:
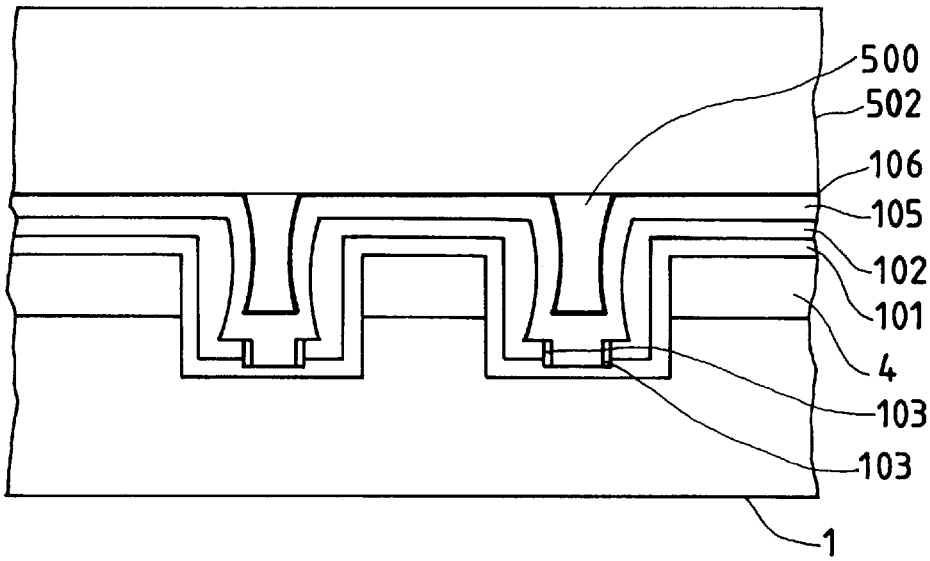
FIG. 40 is a cross-sectional view of a heater portion of a recording head in the example 3 of the invention.

FIG. 40 shows a cross-sectional view of the heat portion.

Next, a recording head 510 using a silicon substrate for the ceiling plate will be described below. The processes up to forming the interlayer film 102 are identical to those of the example 1 (FIGS. 4 to 8), and will be not described any more. Note that no groove 120 is formed on the element substrate.

(6) Then, to make the electrical connection, a part of the interlayer film 102 above the emitter region and the base/collector region was opened by photolithography to form a through hole TH.

(7) Next, $HfB_2$ as the heating resistive layer 103 was deposited, through a through hole TH, approximately 1000 Å thick on the interlayer film 102, an electrodes 13 and an electrode 12 located above the emitter region and the base/collector region to effect the electrical connection.

(8) On the heating resistive layer 103 was deposited a roughly 5000 Å thick layer made of Al material as a pair of wiring electrodes 104 for electricity-heat conversion element, and a cathode wiring electrode 104 and an anode wiring electrode 109 for diode, and the patterning for Al and TaN (heating resistive layer 103) was made to form the electricity-heat conversion elements and other wirings at the same time. Herein, the patterning of Al is identical to that of the previous method (see FIG. 10).

(9) Thereafter, $SiO_2$ film 105 as the protective layer of electricity-heat conversion element and the insulating layer between Al wirings was deposited about 6000 Å thick by sputtering or CVD, and then Ta as the protective layer 106 for the anti-cavitation was deposited about 2000 Å thick on the heating portion of electricity-heat converter.

(10) By removing partially the electricity-heat conversion elements, Ta and $SiO_2$ film 105 as above made, a bonding pad 107 was formed. Note that the protective film 105 may be SiON or SiN, in addition to $SiO_2$ (see FIG. 11).

Figure 33:
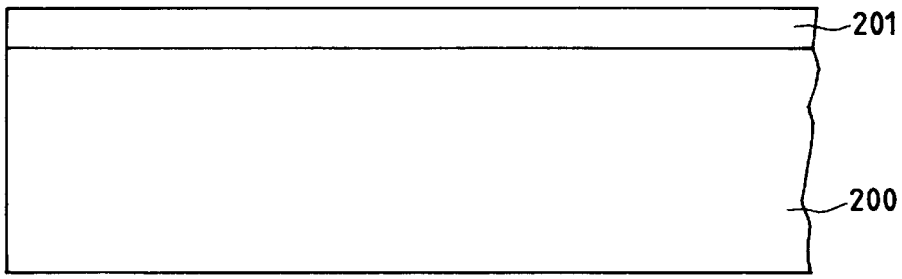
FIG. 33 is a cross-sectional view for exemplifying a manufacturing method of a heater portion of an ink jet head in an example 4 of the invention.
Figure 34:
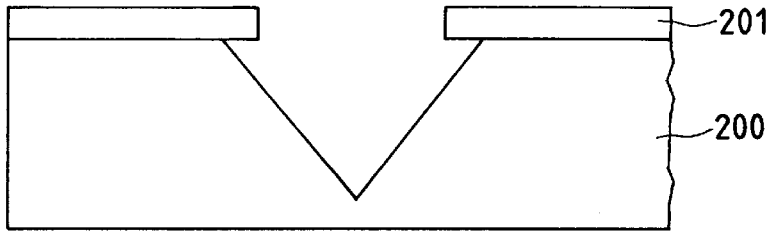
FIG. 34 is a cross-sectional view for exemplifying the manufacturing method of the heater portion of the ink jet head in the example 4 of the invention.
Figure 35:
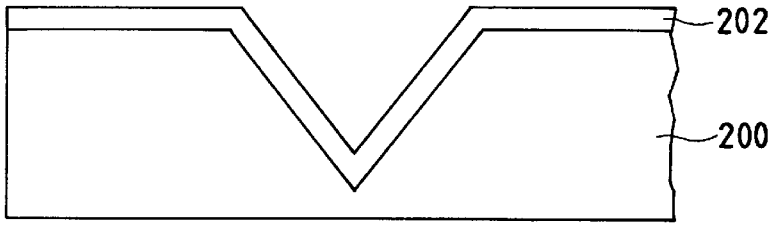
FIG. 35 is a cross-sectional view for exemplifying the manufacturing method of the heater portion of the ink jet head in the example 4 of the invention.
Figure 41:
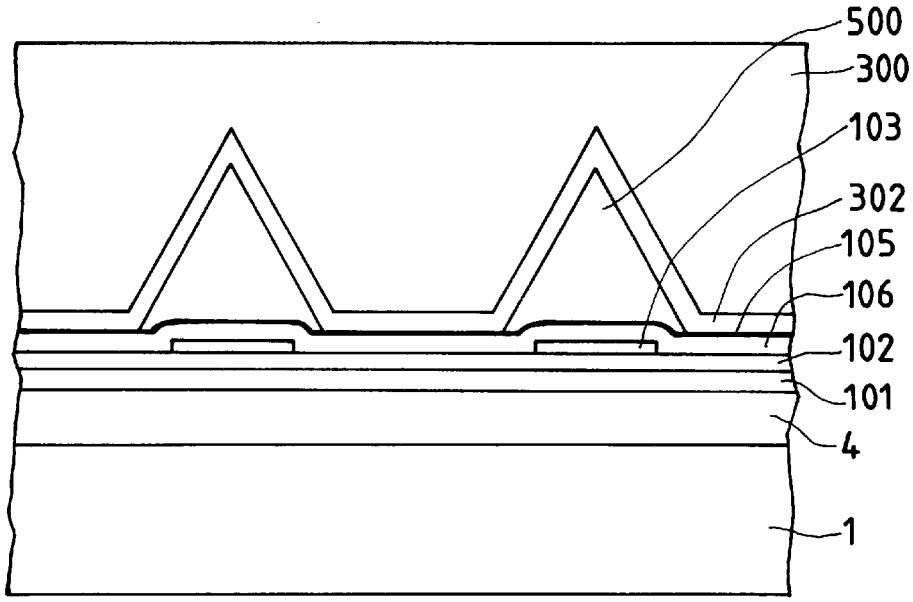
FIG. 41 is a cross-sectional view of a heater portion in the example 4 of the invention.

(11) Next, an approximately 8000 Å thick silicon oxide film 201 was formed by thermally oxidizing another silicon substrate 200 (FIG. 33). And after removing the oxide film using photolithography technique, silicon was etched in an alkaline solution (e.g., KOH) (FIG. 34). The etching was an anisotropic etching, wherein the V-shaped groove was formed. Then, after removing the silicon oxide film entirely, the thermal oxidation was conducted 5000 Å thick to form a silicon oxide film 202 (FIG. 35). This was cut out into separate chips, each of which was bonded in alignment with a diode substrate having the heater formed, and an ink tank was placed thereon, thereby fabricating a recording head. FIG. 41 shows a cross-sectional view of the heater portion.

This example is not specifically limited to this process, but may be applicable to the methods of examples 1, 2 and 3.

While in this example the V-shaped groove is formed using an anisotropic etching of silicon in an alkaline solution, it will be appreciated that the isotropic groove by etching of acid (hydrofluoric acid or nitric acid type) or the groove having vertical cross section structure by dry etching may be formed with the same effects.

Because by using Si for the ceiling plate as in this example, the thermal expansion coefficient of Si for the head base body and that of the ceiling plate can be matched, a highly reliable recording head without having any offset discharge orifices can be provided.

Next, a recording head 510 of a fifth example in which a heater is incorporated into the ceiling plate will be described below. Note that the processes up to forming the interlayer film 102 are identical to those of the example 1 (FIGS. 4 to 9), and will not be described any more. Note that no groove 121 serving as the ink flow passage is formed on the element substrate (first element substrate) on the side where the function element is provided.

(7) Next, $HfB_2$ as the heating resistive layer 103 was deposited, through a through hole TH, approximately 1000 Å thick on the interlayer film 102, an electrodes 13 and an electrode 12 located above the emitter region and the base/collector region to effect the electrical connection.

(8) On the heating resistive layer 103 was deposited a roughly 5000 Å thick layer made of Al material as a pair of wiring electrodes 104 for electricity-heat conversion element, and a cathode wiring electrode 104 and an anode wiring electrode 109 for diode, and the patterning for Al and $HfB_2$ (heating resistive layer 103) was made to form the electricity-heat conversion elements and other wirings at the same time. Herein, the patterning of Al is identical to that of the previous method (see FIG. 10).

(9) Thereafter, $SiO_2$ film 105 as the protective layer of electricity-heat conversion element and the insulating layer between Al wirings was deposited about 6000 Å thick by sputtering or CVD, and then Ta as the protective layer 106 for the anticavitation was deposited about 2000 Å thick on the heating portion of electricity-heat converter.

(10) By removing partially the electricity-heat conversion elements, Ta and $SiO_2$ film 105 as above made, a bonding pad 107 was formed. Note that the protective film 105 may be SiON or SiN, in addition to $SiO_2$ (see FIG. 11).

Figure 36:
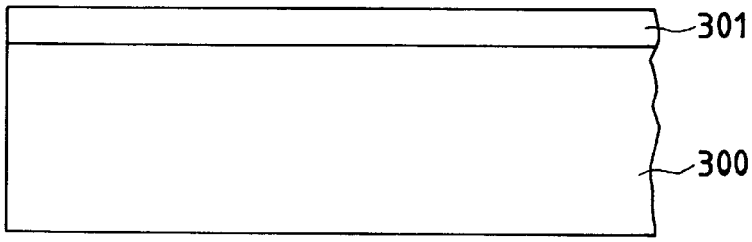
FIG. 36 is a cross-sectional view for exemplifying a manufacturing method of a heater portion of an ink jet head in an example 5 of the invention.
Figure 37:
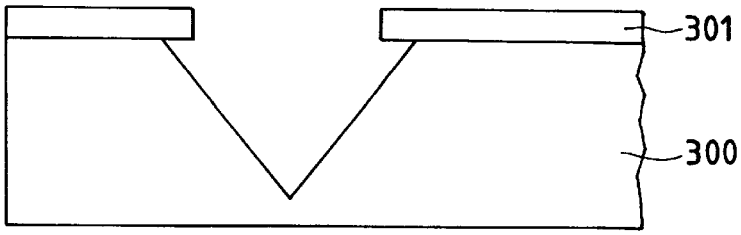
FIG. 37 is a cross-sectional view for exemplifying the manufacturing method of the heater portion of the ink jet head in the example 5 of the invention.
Figure 38:
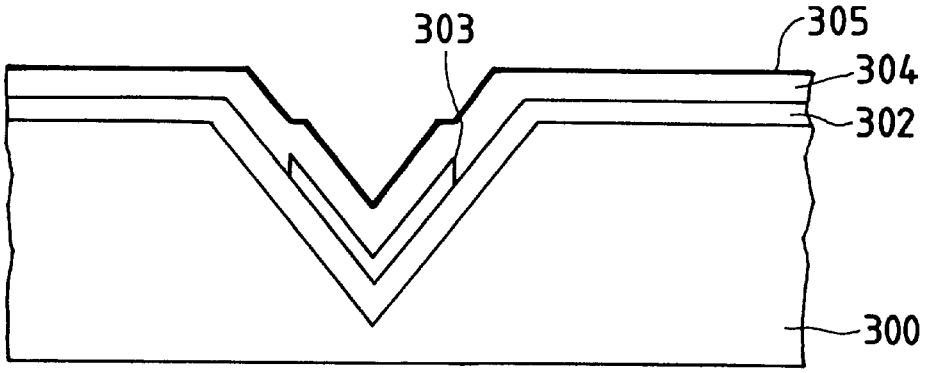
FIG. 38 is a cross-sectional view for exemplifying the manufacturing method of the heater portion of the ink jet head in the example 5 of the invention.
Figure 42:
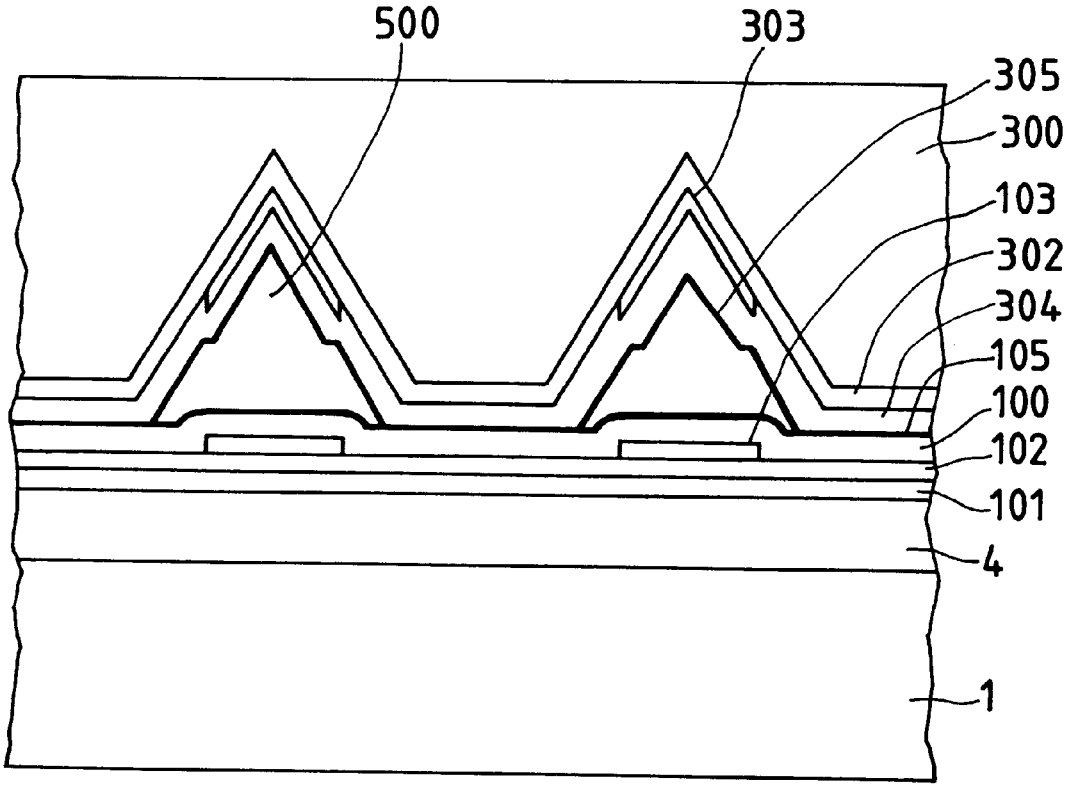
FIG. 42 is a cross-sectional view of a heater portion in the example 5 of the invention.
Figure 43:
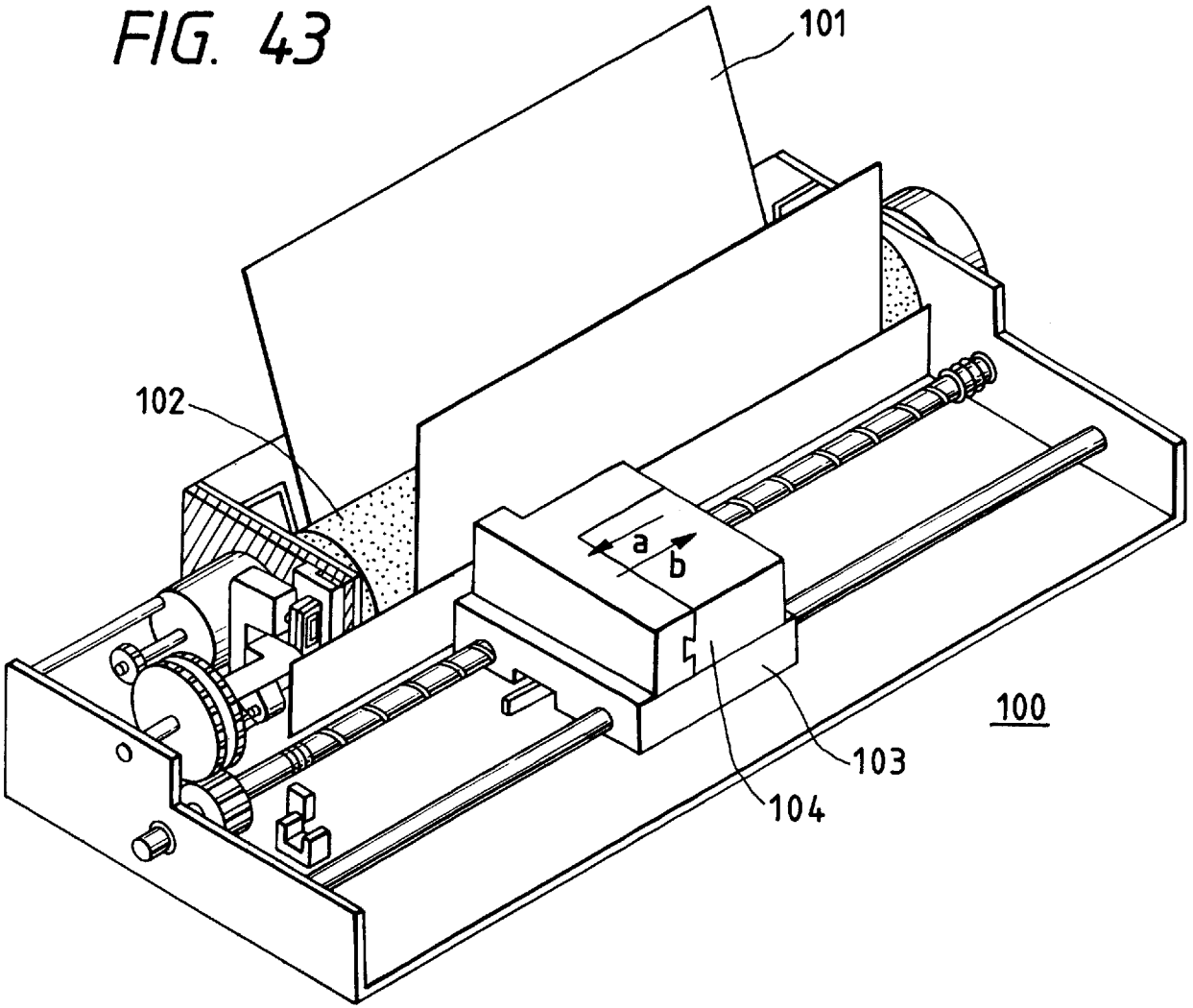
FIG. 43 is a view showing an ink jet apparatus with an ink jet head cartridge of the invention mounted thereon.

(11) Next, an approximately 8000 Å thick silicon oxide film 301 was formed by thermally oxidizing a silicon substrate 300 which becomes a ceiling plate (FIG. 36). And after removing the oxide film using photolithography technique, silicon was etched in an alkaline solution (e.g., KOH). The etching was an anisotropic etching, wherein the V-shaped groove was formed (FIG. 37). Then, after removing the silicon oxide film entirely, a 12000 Å thick thermally oxidized film 302 was formed. TaN 303 as the heating resistive element was deposited 1000 Å thereon. On the heating resistive layer, an approximately 5000 Å thick layer made of Al material was deposited to provide the wiring electrode of electricity-heat conversion element and underlying silicon and the collector, and the patterning was performed to form a heater pattern. Then, $SiO_2$ film as the protective layer of electricity-heat conversion element and the insulating layer was deposited about 6000 Å thick by sputtering or CVD, and Ta 305 as the protective layer for the anti-cavitation was deposited 2000 Å thick (FIG. 38). And a through hole TH aperture for forming an Al bump was opened to make electrical contact with the underlying silicon element, and the Al bump was formed. This ceiling plate was bonded in registration with a silicon substrate having diodes formed thereon, and an ink tank was placed thereon, thereby fabricating a recording head. FIG. 42 shows a cross-sectional view of the heater portion.

While in this example the V-shaped groove is formed using an anisotropic etching of silicon in an alkaline solution, it will be appreciated that the isotropic groove by using an etching solution of acid (hydrofluoric acid or nitric acid type) or the groove having vertical cross section structure by dry etching may be formed with the same effects.

This example is not limited to this process, but may be implemented similarly by the methods of the examples 1, 2 and 3.

As described above, the ink nozzles can be formed within the silicon substrate by forming the grooves in the silicon substrate. This allows the heater material which is the heat generator and the ink nozzles to be formed in self-alignment, whereby the simplification and the higher performance of the process can be attained. Also, by reducing the heater portion or providing a heater on the ceiling plate, the more effective use of the heat generated amount can be made. By incorporating the heater into the ceiling plate, the heater can be halved in length as compared with the conventional heater, whereby the heating center of the heater portion becomes closer to the top end of the nozzle, so that the faster driving can be realized.

An ink jet cartridge using an ink jet head of the invention and an ink jet apparatus having this ink jet head mounted thereon will be described below.

The ink jet head cartridge has an ink jet head (104) of each example as above described and an ink vessel (to the right of 104 in the figure) holding the ink supplied to the ink jet head (to the left of 104 in the figure) jointed together. An ink jet apparatus 100 of the invention comprises a carriage for mounting the ink jet head as above described, recording medium conveying means such as a platen 102 for conveying a recording medium 101 such as a paper, a cloth, or an OHP sheet, and drive signal supply means for driving the ink jet head.

In the ink jet head cartridge and the ink jet apparatus as above described, the excellent and fast recording can be achieved with the effects of the ink jet apparatus as previously described.

What is claimed is:

1. An ink jet head for discharging an ink from a plurality of discharge orifices, comprising:

a plurality of electricity-heat conversion elements for generating heat energy to be applied to the ink and being formed on an element substrate; and a plurality of function elements each electrically connected to each of said electricity-heat conversion elements for selectively driving said electricity-heat conversion elements and being formed on said element substrate;

wherein said element substrate has a plurality of v-shaped grooves formed by an anisotropic etching and constituting ink flow passages for supplying the ink to said discharge orifices, said electricity-heat conversion elements being provided on side walls of said v-shaped grooves.

2. An ink jet head according to claim 1, further comprising a substrate which forms ink flow passages from the grooves in the element substrate by bonding with said element substrate.

3. An ink jet head cartridge for performing recording by discharging an ink, comprising:

an ink jet head according to claim 1; and an ink container for holding the ink being supplied to said ink jet head.

4. An ink jet apparatus for performing recording by discharging an ink, comprising:

an ink jet recording head for discharging an ink from a plurality of discharge orifices, comprising, a plurality of electricity-heat conversion elements for generating heat energy to be applied to the ink and being formed on an element substrate, and function elements each electrically connected to each of said electricity-heat conversion elements for selectively driving said electricity-heat conversion elements and being formed on said element substrate, wherein said element substrate has a plurality of v-shaped grooves formed by an anisotropic etching and constituting ink flow passages for supplying the ink to said discharge orifices, said electricity-heat conversion elements being provided on side walls of said v-shaped grooves; and recording medium conveying means for conveying a recording medium which receives the ink discharged from said ink jet head.

5. An ink jet apparatus for performing recording, comprising:

an ink jet recording head for discharging an ink from a plurality of discharge orifices, comprising, a plurality of electricity-heat conversion elements for generating heat energy to be applied to the ink and being formed on an element substrate, and function elements each electrically connected to each of said electricity-heat conversion elements for selectively driving said electricity-heat conversion elements and being formed on said element substrate, wherein said element substrate has a plurality of v-shaped grooves formed by an anisotropic etching and constituting ink flow passages for supplying the ink to said discharge orifices, said electricity-heat conversion elements being provided on side walls of said v-shaped grooves; and driving signal supply means for supplying a signal for driving said ink jet recording head to said ink jet head.

6. An ink jet head for discharging an ink from discharge orifices, comprising:

a first element substrate having a plurality of grooves which constitute ink flow passages for supplying the ink to said discharge orifices, and electricity-heat conversion elements, disposed in said grooves, for generating heat energy to be applied to the ink; and a second element substrate having function elements for driving said electricity-heat conversion elements incorporated in said first element substrate;

wherein said first element substrate and said second element substrate are bonded together to form ink flow passages between said second element substrate and the grooves of said first element substrate, and the electricity-heat conversion elements of said first element substrate and the function elements of said second element substrate are electrically connected.

7. An ink jet head according to claim 2, wherein said first element substrate and said second element substrate are mainly composed of silicon.

8. An ink jet head cartridge for performing recording by discharging an ink, comprising:

an ink jet head according to claim 2; and an ink jet container for holding the ink to be supplied to said ink jet head.

9. An ink jet apparatus for performing recording by discharging an ink, comprising:

an ink jet recording head for discharging an ink from a plurality of discharge orifices, comprising, a first element substrate having a plurality of grooves which constitute ink flow passages for supplying the ink to said discharge orifices, and electricity-heat conversion elements, disposed in said grooves, for generating heat energy to be applied to the ink, and a second element substrate having function elements for driving said electricity-heat conversion elements incorporated in said first element substrate, wherein said first element substrate and said second element substrate are bonded together to form ink flow passages between said second element substrate and the grooves of said first element substrate, and the electricity-heat conversion elements of said first element substrate and the function elements of said second element substrate are electrically connected; and recording medium conveying means for conveying a recording medium which receives the ink discharged from said ink jet head.

10. An ink jet apparatus for performing recording, comprising:

an ink jet recording head for discharging an ink from a plurality of discharge orifices, comprising, a first element substrate having a plurality of grooves which constitute ink flow passages for supplying the ink to said discharge orifices, and electricity-heat conversion elements, disposed in said grooves, for generating heat energy to be applied to the ink, and a second element substrate having function elements for driving said electricity-heat conversion elements incorporated in said first element substrate, wherein said first element substrate and said second element substrate are bonded together to form ink flow passages between said second element substrate and the grooves of said first element substrate, and the electricity-heat conversion elements of said first element substrate and the function elements of said second element substrate are electrically connected; and driving signal supplying means for supplying a signal for driving said ink jet recording head to said ink jet head.

11. An ink jet head for discharging an ink from a plurality of discharge orifices, comprising:

a plurality of electricity-heat conversion elements for generating heat energy to be applied to the ink and being formed on an element substrate; and wherein said element substrate has a plurality of v-shaped grooves formed by an anisotropic etching and constituting ink flow passages for supplying the ink to said discharge orifices, said electricity-heat conversion elements being provided on side walls of said v-shaped grooves.

12. An ink jet apparatus for performing recording by discharging an ink, comprising:

an ink jet recording head for discharging an ink from a plurality of discharge orifices, comprising, a plurality of electricity-heat conversion elements for generating heat energy to be applied to the ink and being formed on an element substrate, wherein said element substrate has a plurality of v-shaped grooves formed by an anisotropic etching and constituting ink flow passages for supplying the ink to said discharge orifices, said electricity-heat conversion elements being provided on side walls of said v-shaped grooves; and recording medium conveying means for conveying a recording medium which receives the ink discharged from said ink jet head.

13. An ink jet apparatus for performing recording, comprising:

an ink jet recording head for discharging an ink from a plurality of discharge orifices, comprising, a plurality of electricity-heat conversion elements for generating heat energy to be applied to the ink and being formed on an element substrate, wherein said element substrate has a plurality of v-shaped grooves formed by an anisotropic etching and constituting ink flow passages for supplying the ink to said discharge orifices, said electricity-heat conversion elements being provided on side walls of said v-shaped grooves; and driving signal supply means for supplying a signal for driving said ink jet recording head to said ink jet head.

* * * * *

UNITED STATES PATENT AND TRADEMARK OFFICE

CERTIFICATE OF CORRECTION

PATENT NO. : 6,070,968

DATED : June 6, 2000

INVENTOR(S) : YUTAKA AKINO ET AL.

It is certified that error appears in the above-identified patent and that said Letters Patent is hereby corrected as shown below:

ON THE TITLE PAGE:

[56] References Cited, Under Foreign Patent Documents:

"5220960" should read --5-220960-- and insert: --0518467 12/1992 EPO;
0954155 10/1991 EPO;
3-158242 8/1991 Japan; and
4-161341 4/1992--.

COLUMN 5:

Line 31, Q: "region 5,8" should read --regions 5 and 88--; and
Line 61, "13, 14" should read --13 and 14--.

COLUMN 6:

Line 3, "13,14" should read --13 and 14--.

COLUMN 7:

Line 21, "6,9." should read --6 and 9.--; and
Line 22, "6,9" should read --6 and 9--.

COLUMN 9:

Line 56, "described" should read --be described--.

UNITED STATES PATENT AND TRADEMARK OFFICE

CERTIFICATE OF CORRECTION

PATENT NO. : 6,070,968

DATED : June 6, 2000

INVENTOR(S) : YUTAKA AKINO ET AL.

It is certified that error appears in the above-identified patent and that said Letters Patent is hereby corrected as shown below:

COLUMN 11:

Line 48, "described" should read --be described--.

COLUMN 13:

Line 36, "electrodes" should read --electrode--; and
Line 52, "anti-cavitation" should read --anticavitation--.

COLUMN 14:

Line 29, "electrodes" should read --electrode--.

COLUMN 15:

Line 3, "anti-cavitation" should read --anticavitation--.

COLUMN 16:

Line 13, "comprising," should read --comprising:--; and
Line 34, "comprising," should read --comprising--.

UNITED STATES PATENT AND TRADEMARK OFFICE

CERTIFICATE OF CORRECTION

PATENT NO. : 6,070,968

DATED : June 6, 2000

INVENTOR(S) : YUTAKA AKINO ET AL. Page 3 of 3

It is certified that error appears in the above-identified patent and that said Letters Patent is hereby corrected as shown below:

COLUMN 17:

Line 3, "claim 2," should read --claim 6,--;
Line 8, "claim 2;" should read --claim 6;--;
Line 13, "comprising," should read --comprising:--; and
Line 35, "comprising," should read --comprising:--.

COLUMN 18:

Line 20, "comprising," should read --comprising:--; and
Line 36, "comprising," should read --comprising:--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*